US011478041B2

(12) United States Patent
Bischoff et al.

(10) Patent No.: US 11,478,041 B2
(45) **Date of Patent: *Oct. 25, 2022**

(54) PRESSURE MAPPED MIDSOLES, ARTICLES OF FOOTWEAR INCLUDING THE SAME, AND METHODS OF MAKING THE SAME

(71) Applicant: Reebok International Limited, London (GB)

(72) Inventors: Robert Bischoff, Attleboro, MA (US); Matthew Boudreau, North Attleboro, MA (US)

(73) Assignee: Reebok International Limited, London (GB)

( * ) Notice: Subject to any disclaimer, the term of this patent is extended or adjusted under 35 U.S.C. 154(b) by 518 days.

This patent is subject to a terminal disclaimer.

(21) Appl. No.: 16/366,804

(22) Filed: Mar. 27, 2019

(65) Prior Publication Data

US 2019/0216170 A1 Jul. 18, 2019

Related U.S. Application Data

(63) Continuation of application No. 14/928,691, filed on Oct. 30, 2015, now Pat. No. 10,251,446.

(51) Int. Cl.
*A43B 13/14* (2006.01)
*A43B 13/22* (2006.01)
(Continued)

(52) U.S. Cl.
CPC ..... *A43B 13/186* (2013.01); *A43B 7/141* (2013.01); *A43B 13/125* (2013.01); *A43B 13/14* (2013.01);
(Continued)

(58) Field of Classification Search
CPC ..... A43B 13/186; A43B 7/141; A43B 13/125; A43B 13/14; A43B 13/188; A43B 13/223;
(Continued)

(56) References Cited

U.S. PATENT DOCUMENTS 4,187,620 A 2/1980 Selner
4,733,483 A 3/1988 Lin
(Continued)

FOREIGN PATENT DOCUMENTS

EP 0 752 216 A2 1/1997
EP 2 433 515 A2 3/2012
WO WO 99/052387 A1 10/1999

OTHER PUBLICATIONS

Burnfield et al., "The influence of walking speed and footwear on plantar pressures in older adults," Clinical Biomechanics 19 (2004) pp. 78-84.

(Continued)

*Primary Examiner* — Jameson D Collier
(74) *Attorney, Agent, or Firm* — Sterne, Kessler, Goldstein & Fox P.L.L.C.

(57) ABSTRACT

Midsoles, and articles of footwear having such midsoles, with a distal surface profile based, in whole or in part, on a pressure map of pressures exerted on the bottom of a human foot when in contact with the ground are provided. The pressure map may be a measurement of the pressures exerted on the bottom of a human foot during, for example, standing, walking, or running (e.g., a natural gait). The distal surface profile of a midsole and an article of footwear may be defined, at least in part, by a plurality of cushioning projections extending from the midsole and having predetermined height profiles based on a pressure map. Methods of making midsoles and articles of footwear including a distal surface profile based, in whole or in part, on a pressure map are also provided.

21 Claims, 21 Drawing Sheets

(51) Int. Cl.

| | |
|---|---|
| ***A43B 13/18*** | (2006.01) |
| ***A43B 13/12*** | (2006.01) |
| ***A43B 7/1405*** | (2022.01) |
| ***A43D 1/02*** | (2006.01) |

(52) U.S. Cl.
CPC ..... *A43B 13/188* (2013.01); *A43B 13/223* (2013.01); *A43D 1/02* (2013.01); *A43D 1/025* (2013.01); *A43D 2200/60* (2013.01)

(58) Field of Classification Search
CPC ..... A43B 13/184; A43D 1/02; A43D 1/025; A43D 2200/60
See application file for complete search history.

(56) References Cited

U.S. PATENT DOCUMENTS

| | | | | |
|---|---|---|---|---|
| 4,759,136 | A * | 7/1988 | Stewart | A43B 7/14 36/114 |
| 4,881,328 | A | 11/1989 | Yung-Mao | |
| 4,905,382 | A | 3/1990 | Yung-Mao | |
| 4,908,962 | A | 3/1990 | Yung-Mao | |
| 5,469,639 | A | 11/1995 | Sessa | |
| 6,425,194 | B1 | 7/2002 | Brie | |
| 6,951,066 | B2 | 10/2005 | Snow | |
| 7,467,484 | B2 | 12/2008 | Chang | |
| 7,954,257 | B2 | 6/2011 | Banik | |
| 8,474,155 | B2 | 7/2013 | McDonald et al. | |
| 10,251,446 | B2 * | 4/2019 | Bischoff | A43B 13/186 |
| 2002/0092202 | A1 | 7/2002 | Masseron | |
| 2002/0140129 | A1 | 10/2002 | Chang | |
| 2004/0016146 | A1 * | 1/2004 | Oman | A43B 13/186 36/29 |
| 2007/0039209 | A1 | 2/2007 | White et al. | |
| 2007/0220778 | A1 | 9/2007 | Fusco et al. | |
| 2008/0201992 | A1 | 8/2008 | Avar et al. | |
| 2008/0216360 | A1 | 9/2008 | Schenone | |
| 2008/0229617 | A1 | 9/2008 | Johnson et al. | |
| 2010/0235258 | A1 * | 9/2010 | Langvin | G06Q 30/0621 705/26.1 |
| 2011/0214313 | A1 | 9/2011 | James et al. | |
| 2012/0073160 | A1 | 3/2012 | Marvin et al. | |
| 2012/0167416 | A1 | 7/2012 | Christensen et al. | |
| 2013/0318828 | A1 | 12/2013 | Sink | |
| 2014/0196308 | A1 | 7/2014 | Baratta et al. | |
| 2015/0290892 | A1 | 10/2015 | Wan et al. | |

OTHER PUBLICATIONS

Cooper et al., "Plantar loading and foot-strike pattern changes with speed during barefoot running in those with a natural rearfoot strike pattern while shod," The Foot 25 (2015), pp. 89-96.
Rethnam et al., "Are old miming shoes detrimental to your feet? A pedobarographic study," BMC Research Notes 2011, 4:307, pp. 1-5.
Caughlan, Tom, "Nike Terra Kiger Review", May 1, 2014, <http://www.irunfar.com/2014/05/nike-terra-kiger-review.html>, retrieved Nov. 4, 2016.
Solereview, "2014 Nike Free 5.0 Review", May 13, 2014, <https://www.solereview.com/2014-nike-free-5-0-review>, retrieved Nov. 4, 2016.
Extended European Search Report dated Mar. 30, 2017, issued in European Patent Application No. EP 16188957.1.

* cited by examiner

PRESSURE MAPPED MIDSOLES, ARTICLES OF FOOTWEAR INCLUDING THE SAME, AND METHODS OF MAKING THE SAME

CROSS-REFERENCE TO RELATED APPLICATIONS

This application is a continuation of and claims priority to U.S. application Ser. No. 14/928,691, filed Oct. 30, 2015, which is incorporated herein by reference in its entirety.

FIELD

The described embodiments generally relate to midsoles, and articles of footwear having such midsoles, with a surface profile based on a pressure map of pressures exerted on the bottom of a human foot when in contact with the ground. In particular, described embodiments relate to midsoles and articles of footwear having a midsole with a plurality of cushioning projections having predetermined height profiles based on a pressure map of pressures exerted on the bottom of a human foot when in contact with the ground.

BACKGROUND

Individuals are often concerned with the amount of cushioning an article of footwear provides. This is true for articles of footwear worn for non-performance activities, such as a leisurely stroll, and for performance activities, such as running, because throughout the course of an average day, the feet and legs of an individual are subjected to substantial impact forces. When an article of footwear contacts a surface, considerable forces may act on the article of footwear and, correspondingly, the wearer's foot. The sole of an article of footwear functions, in part, to provide cushioning to the wearer's foot and to protect it from these forces.

The human foot is a complex and remarkable piece of machinery, capable of withstanding and dissipating many impact forces. The natural padding of fat at the heel and forefoot, as well as the flexibility of the arch, help to cushion the foot. Although the human foot possesses natural cushioning and rebounding characteristics, the foot alone is incapable of effectively overcoming many of the forces encountered during every day activity. Unless an individual is wearing shoes that provide proper cushioning and support, the soreness and fatigue associated with every day activity is more acute, and its onset may be accelerated. This discomfort for the wearer may diminish the incentive for further activity. Equally important, inadequately cushioned footwear can lead to injuries such as blisters; muscle, tendon, and ligament damage; and bone stress fractures. Improper footwear can also lead to other ailments, including back pain.

Proper footwear should be durable, comfortable, and provide other beneficial characteristics for an individual. Therefore, a continuing need exists for innovations in footwear.

BRIEF SUMMARY OF THE INVENTION

Some embodiments are directed towards an article of footwear including an upper, a midsole coupled to the upper having a forefoot end disposed opposite a heel end in a longitudinal direction; the midsole including a proximal surface coupled to the upper, an intermediate surface, and a plurality of cushioning projections extending from the intermediate surface at predetermined heights in a vertical direction substantially perpendicular to the longitudinal direction, each cushioning projection having a predetermined height profile defining a portion of a distal surface of the midsole, where the predetermined height profiles of the cushioning projections are based on a pressure map of pressures exerted on the bottom of a human foot in contact with the ground.

In some embodiments, the midsole may include a peripheral midsole disposed around at least a portion of a core midsole, the core midsole including the plurality of cushioning projections extending from the intermediate surface.

In some embodiments, the predetermined height profiles of the cushioning projections may vary relative to a distal most surface of the peripheral midsole. In some embodiments, the predetermined height profile of a cushioning projection located in a high pressure region of the pressure map may have a larger average height than the average height of a predetermined height profile of a cushioning projection located in a low pressure region of the pressure map.

In some embodiments, the predetermined height profiles of the cushioning projections may vary as function of the pressure values exerted on the bottom of the human foot. In some embodiments, the predetermined height profiles of the cushioning projections may vary in one or more of the longitudinal direction and a transverse direction substantially perpendicular to the longitudinal direction. In some embodiments, the predetermined height profile of a single cushioning projection may vary in one or more of the longitudinal direction and a transverse direction substantially perpendicular to the longitudinal direction as a function of the pressure values exerted on the bottom of the human foot.

In some embodiments, the predetermined height profiles of the cushioning projections may define an undulating overall surface profile corresponding to the pressure map. In some embodiments, the undulating overall surface profile may include one or more valleys and one or more peaks. In some embodiments, the undulating overall surface profile may include a valley positioned at a location corresponding to the arch of the foot in the pressure map.

In some embodiments, the core midsole and the peripheral midsole may be formed of different materials. In some embodiments, the peripheral midsole may be disposed within a recess defined by the core midsole.

In some embodiments, the plurality of cushioning projections may be disposed side-by-side. In some embodiments, the plurality of cushioning projections may be arranged in rows.

In some embodiments, the plurality of cushioning projections may have substantially the same shape. In some embodiments, the plurality of cushioning projections may have a 3-dimensional polygonal shape.

Some embodiments are directed towards a method of manufacturing a midsole for an article of footwear, the method including forming a midsole such that a plurality of cushioning projections extend from the midsole at predetermined heights in a direction substantially perpendicular to a longitudinal direction of the midsole, each cushioning projection having a predetermined height profile based on a pressure map of pressures exerted on the bottom of a human foot when in contact with the ground.

In some embodiments, the pressure map may be a standard pressure map for a human foot having a particular shoe size. In some embodiments, the pressure map may be a pressure map for a specific individual.

Some embodiments are directed towards a midsole including a plurality of cushioning projections extending from the midsole at predetermined heights in a direction substantially perpendicular to a longitudinal direction of the midsole, each cushioning projection having a predetermined height profile based on a pressure map of pressures exerted on the bottom of a human foot when in contact with the ground.

BRIEF DESCRIPTION OF THE DRAWINGS/FIGURES

Figure 3:
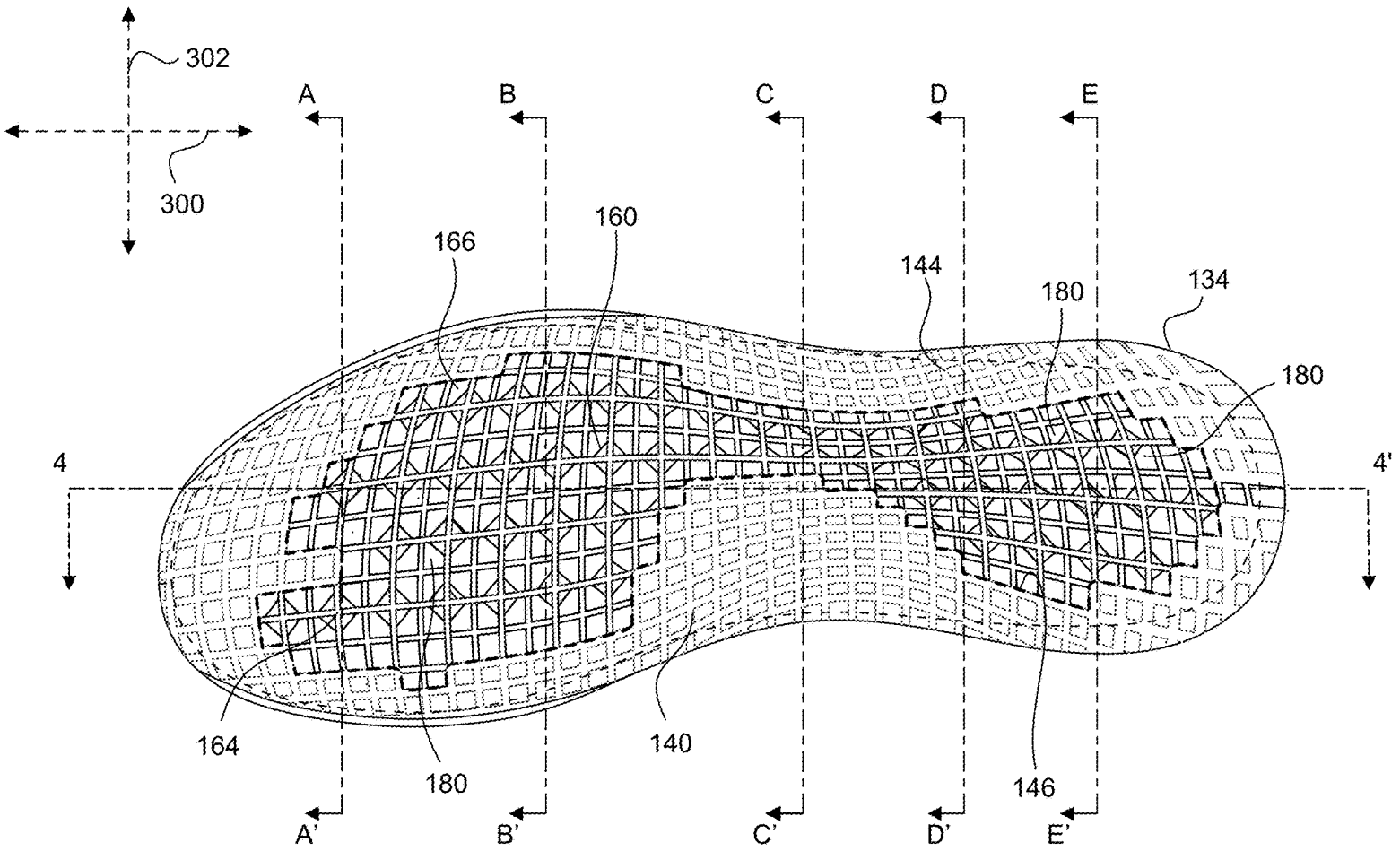
FIG. 3 is bottom view of a sole according to an embodiment.
Figure 5B:
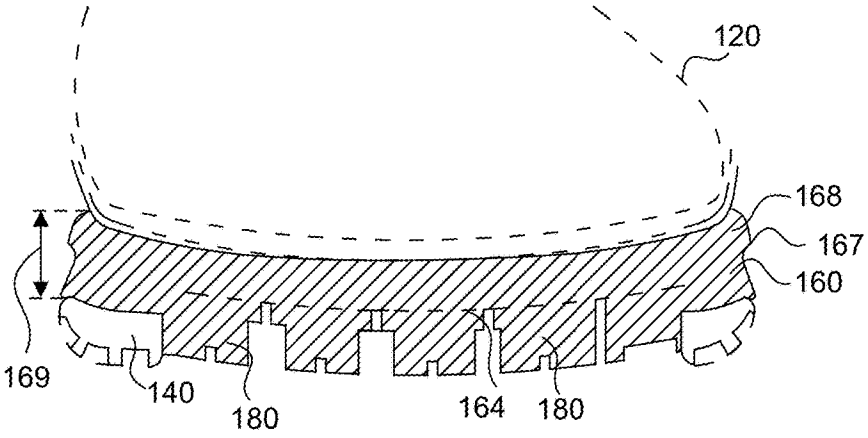
Figure 5A:
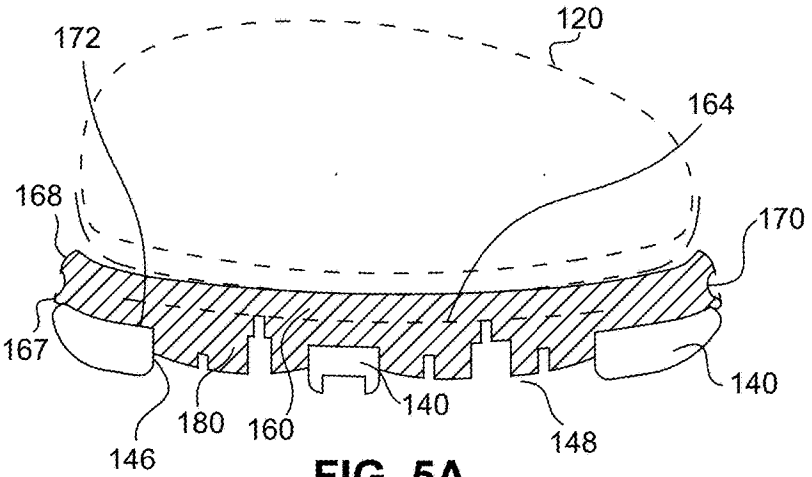
Figure 5C:
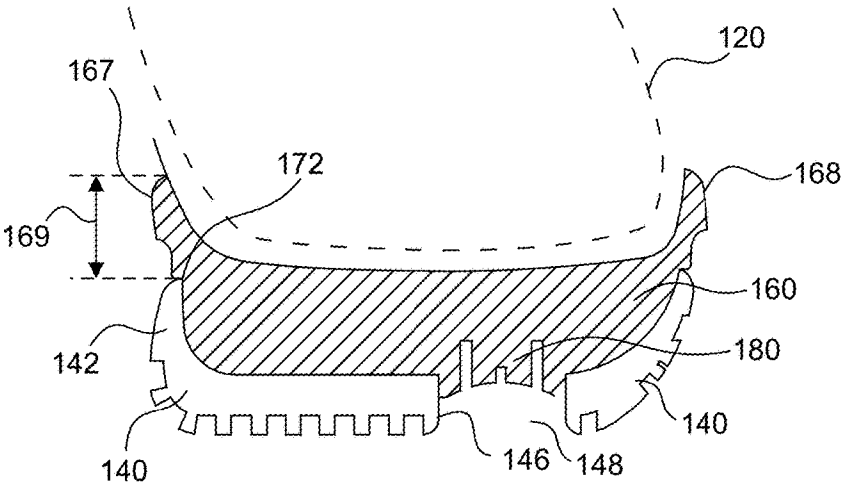
Figure 5E:
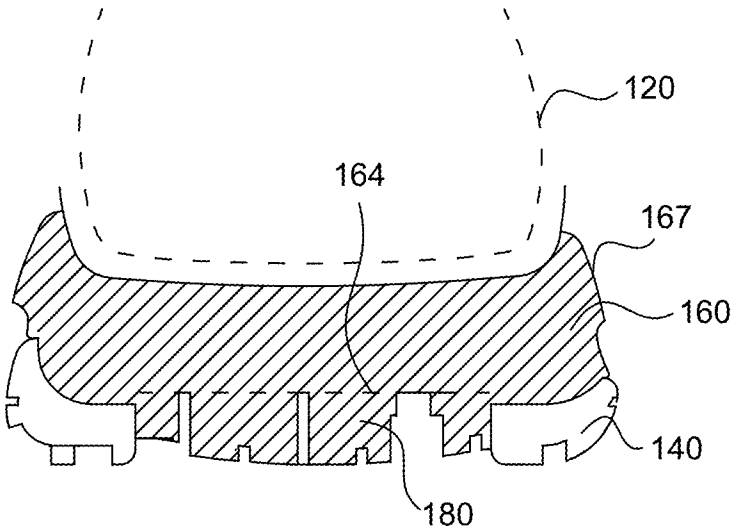
Figure 5D:
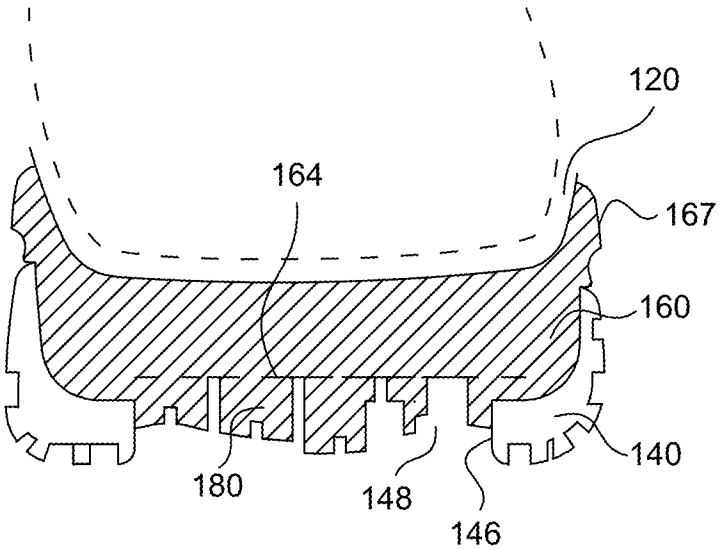

FIG. 5A is a cross-sectional view of a sole according to an embodiment along the line A-A' in FIG. 3. FIG. 5B is a cross-sectional view of a sole according to an embodiment along the line B-B' in FIG. 3. FIG. 5C is a cross-sectional view of a sole according to an embodiment along the line C-C' in FIG. 3. FIG. 5D is a cross-sectional view of a sole according to an embodiment along the line D-D' in FIG. 3. FIG. 5E is a cross-sectional view of a sole according to an embodiment along the line E-E' in FIG. 3.

Figure 6:
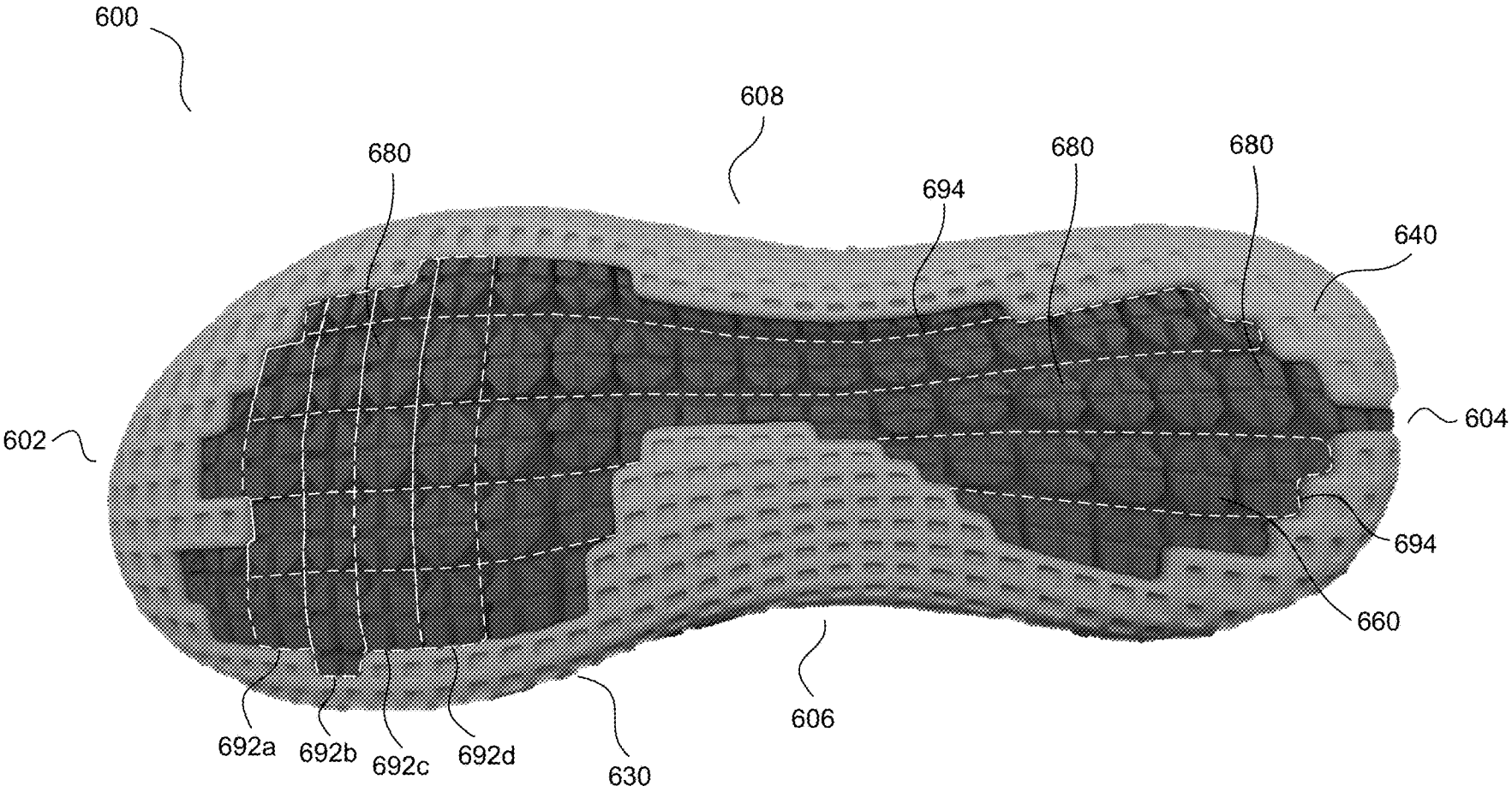

FIG. 6 is a bottom view of an article of footwear according to an embodiment.

Figure 7:
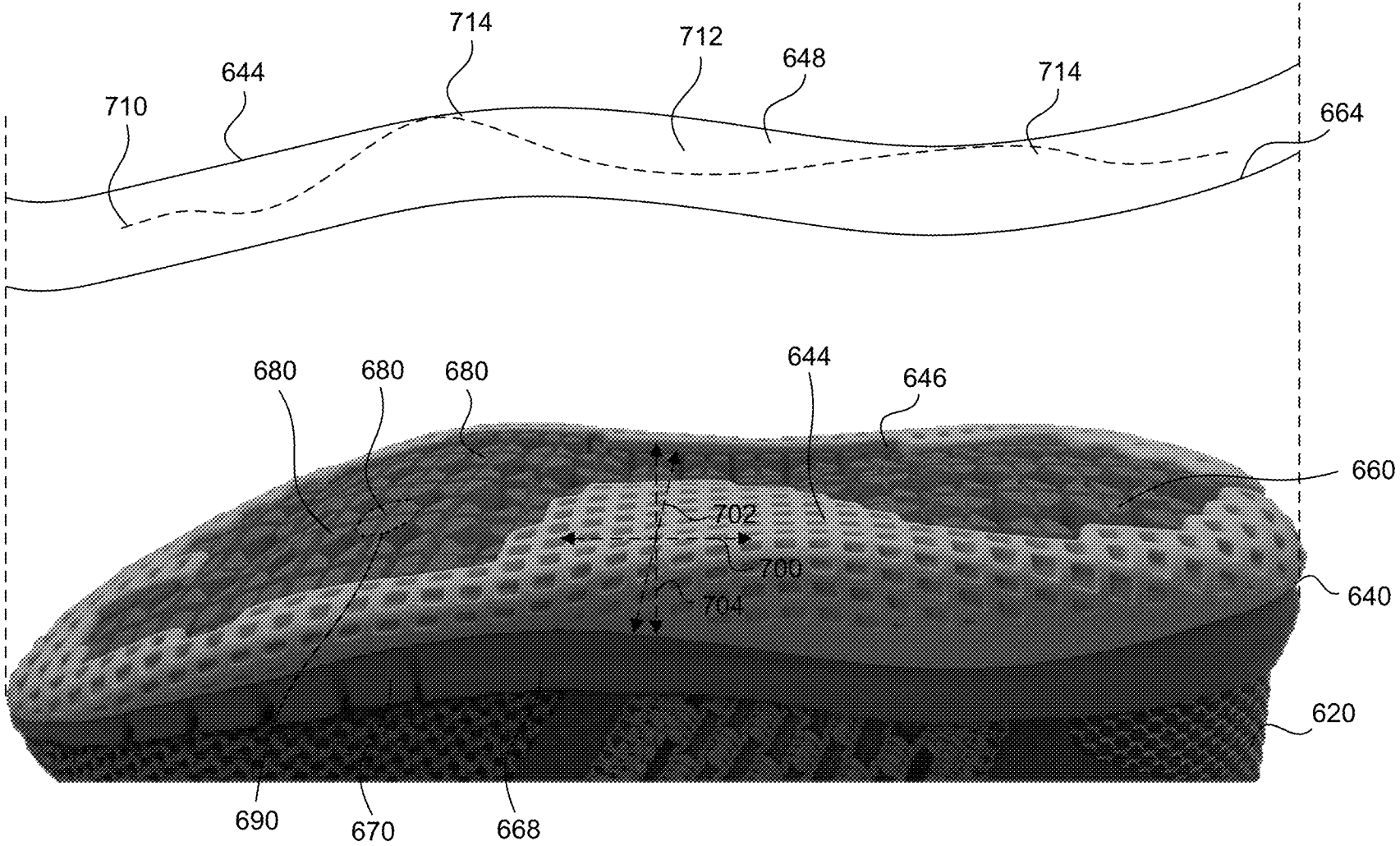

FIG. 7 is a perspective side view of an article of footwear according to an embodiment.

Figure 8:
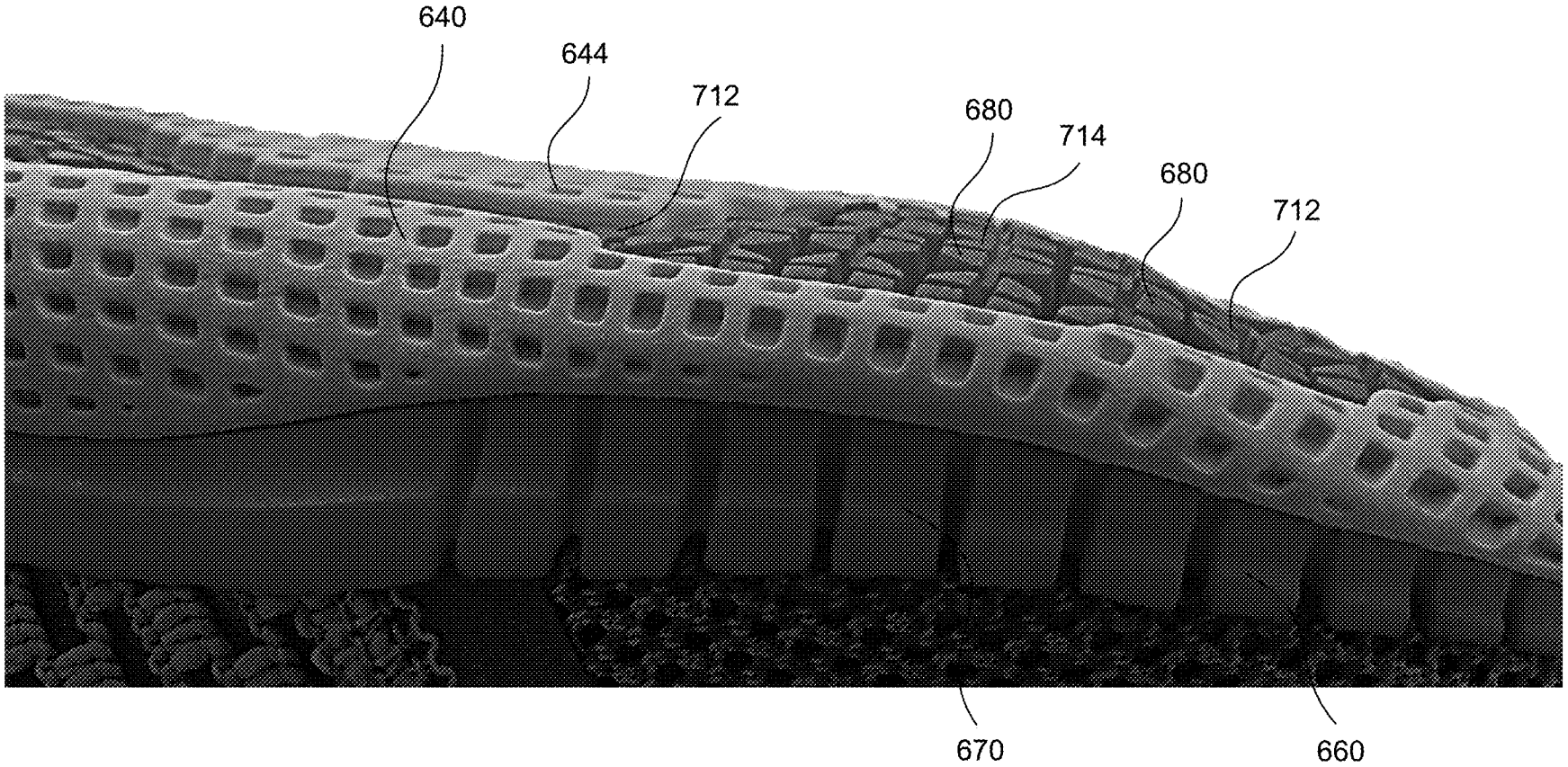

FIG. 8 is a partial side view of an article of footwear according to an embodiment.

Figure 9:
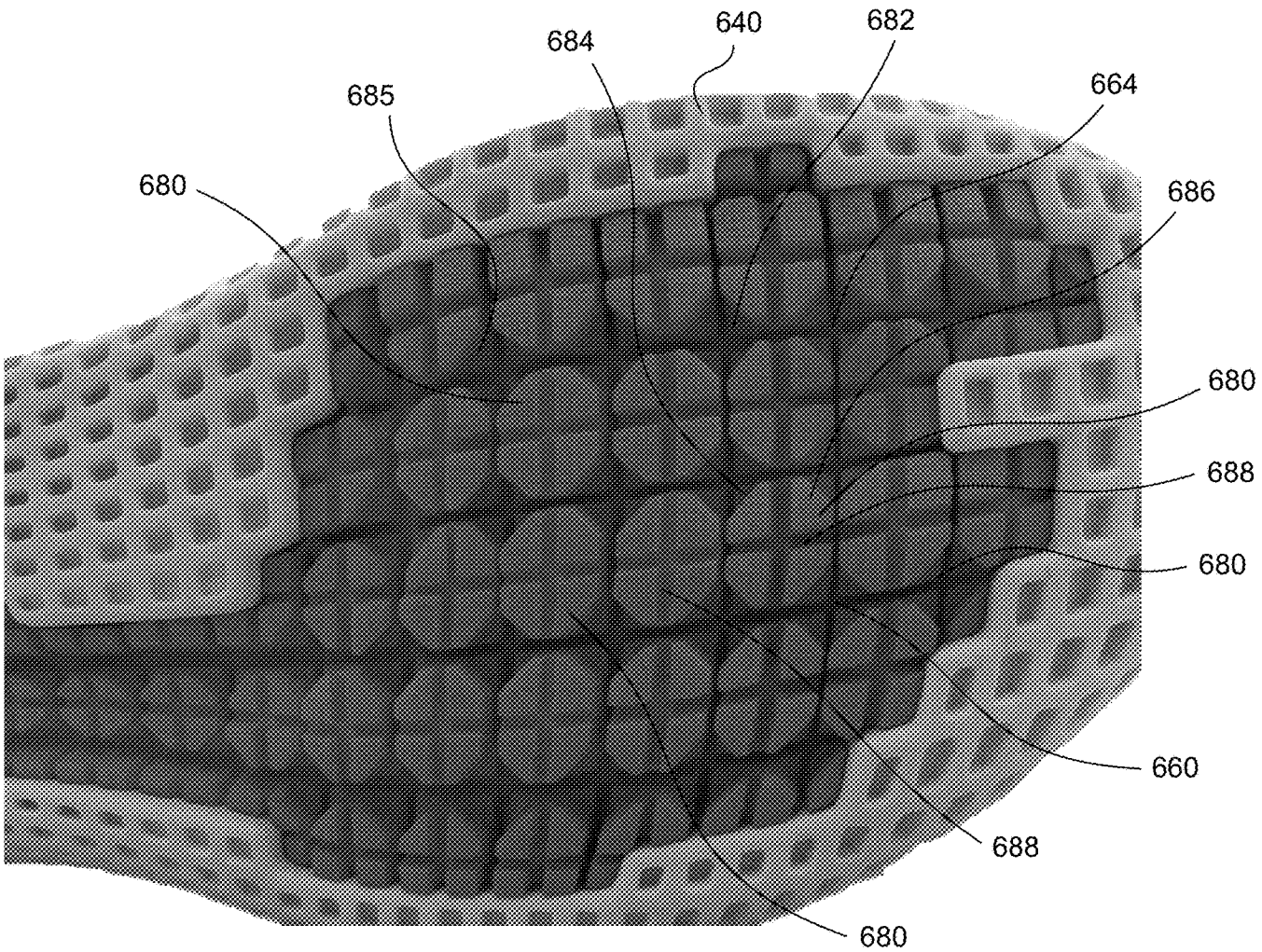

FIG. 9 is a partial bottom view of an article of footwear according to an embodiment.

Figure 10:
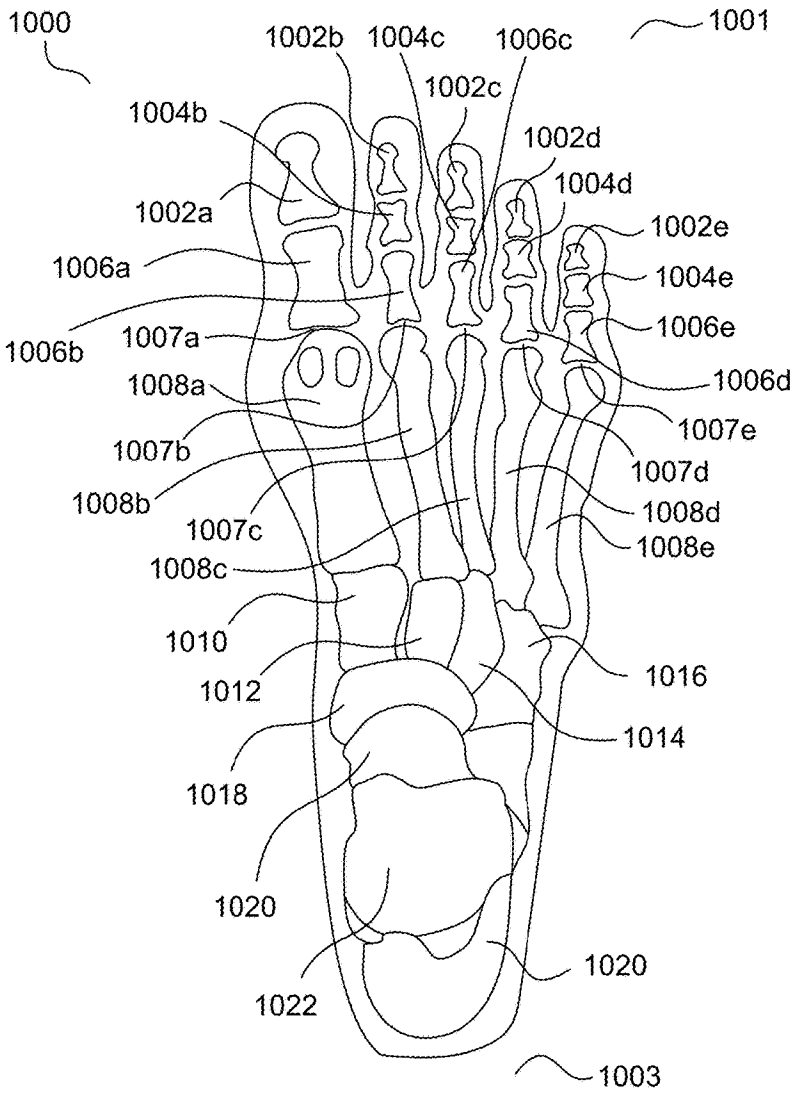

FIG. 10 is a bottom view of an exemplary skeletal structure of a human foot.

Figure 11:
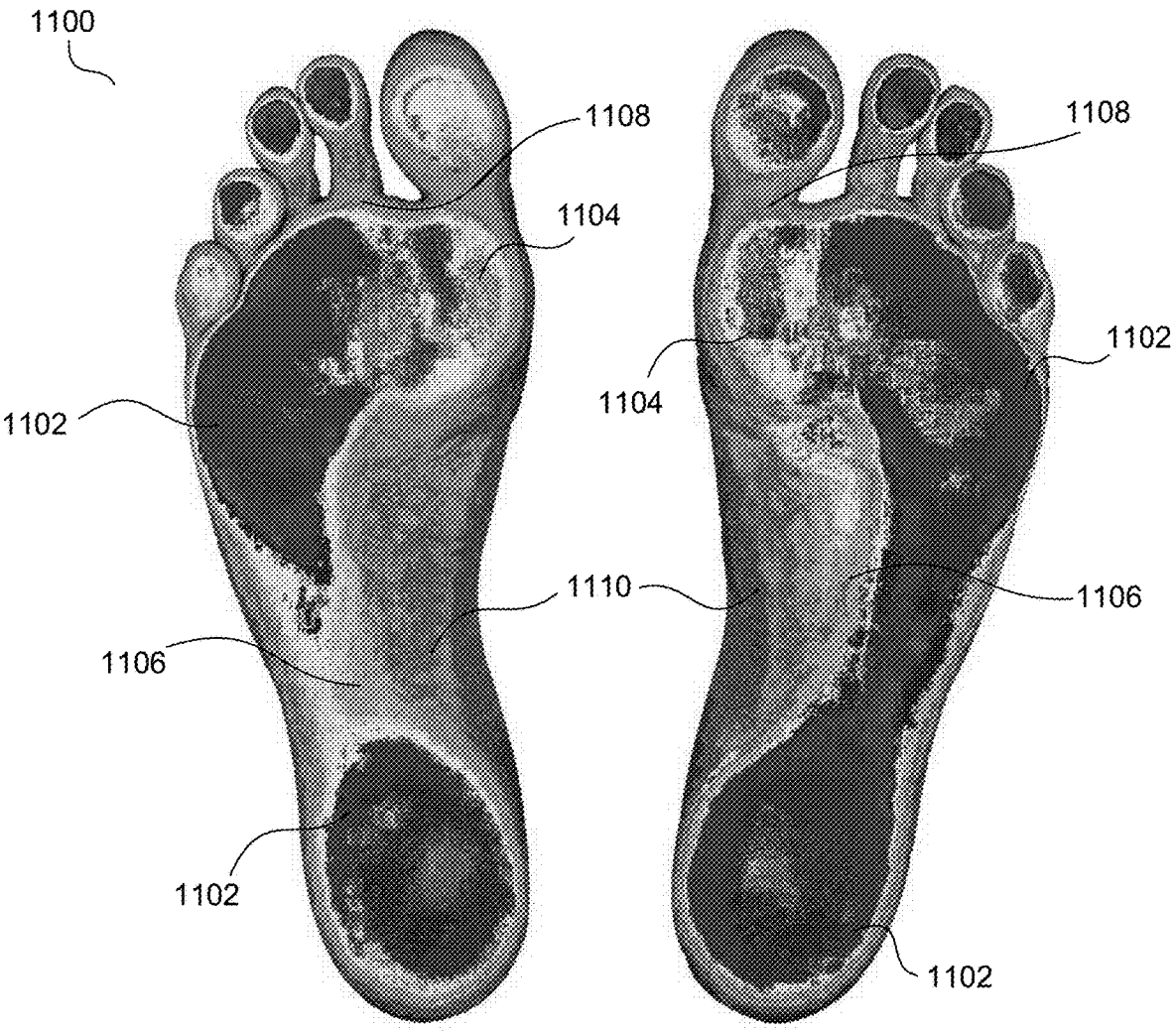

FIG. 11 is an exemplary pressure map of the pressures exerted on the bottom of an individual's feet when standing upright.

Figure 12:
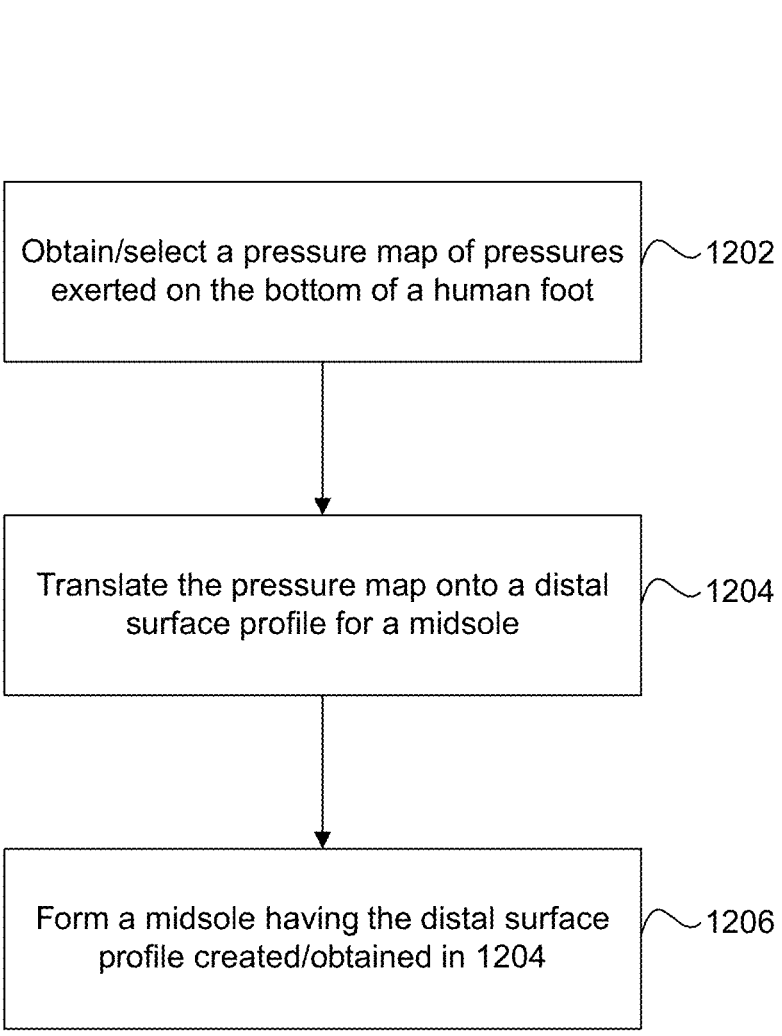

FIG. 12 is a flowchart of an exemplary method of manufacturing a midsole for an article of footwear according to an embodiment.

Figure 13:
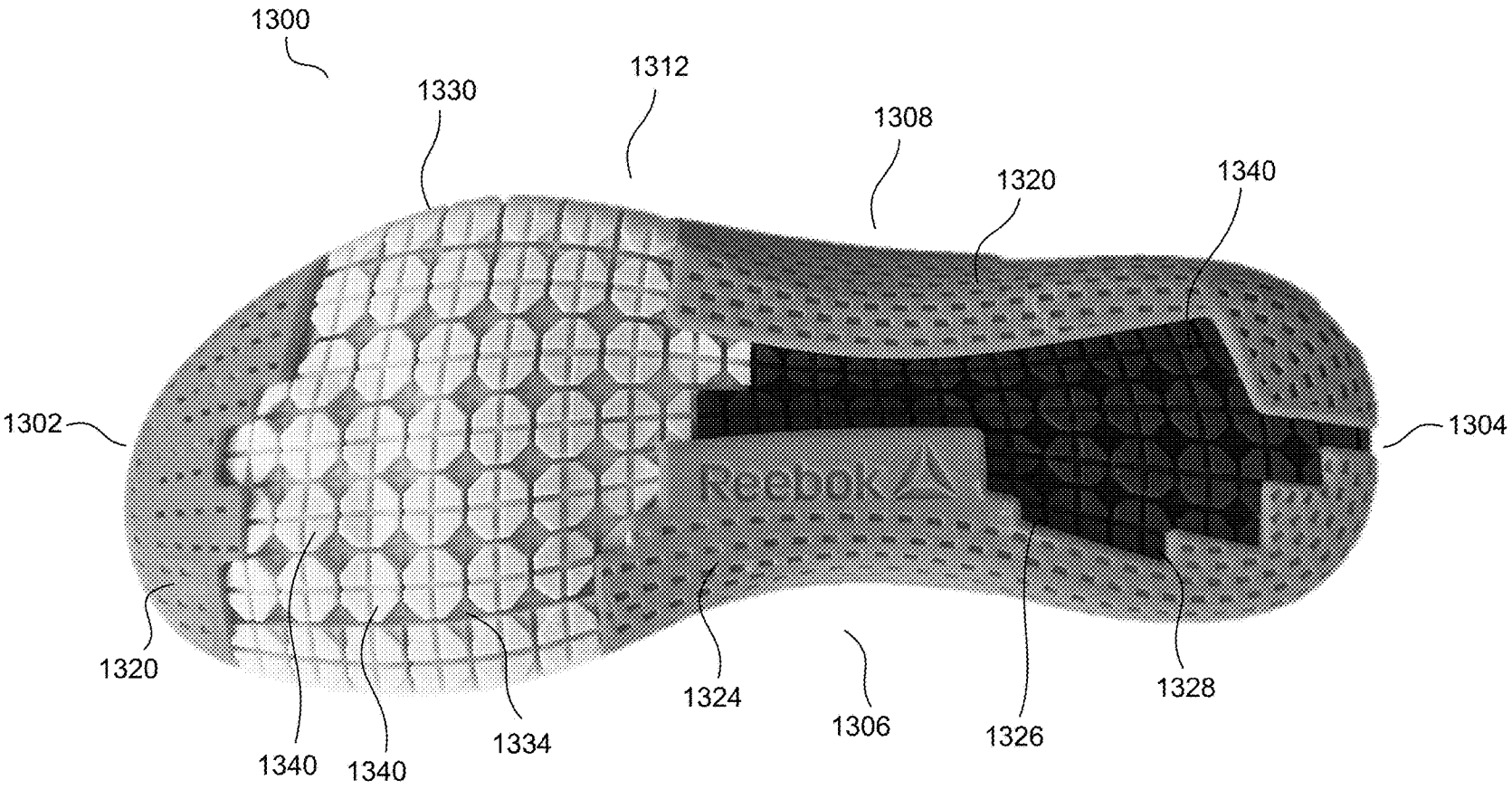

FIG. 13 is a bottom view of a midsole according to an embodiment.

Figure 14:
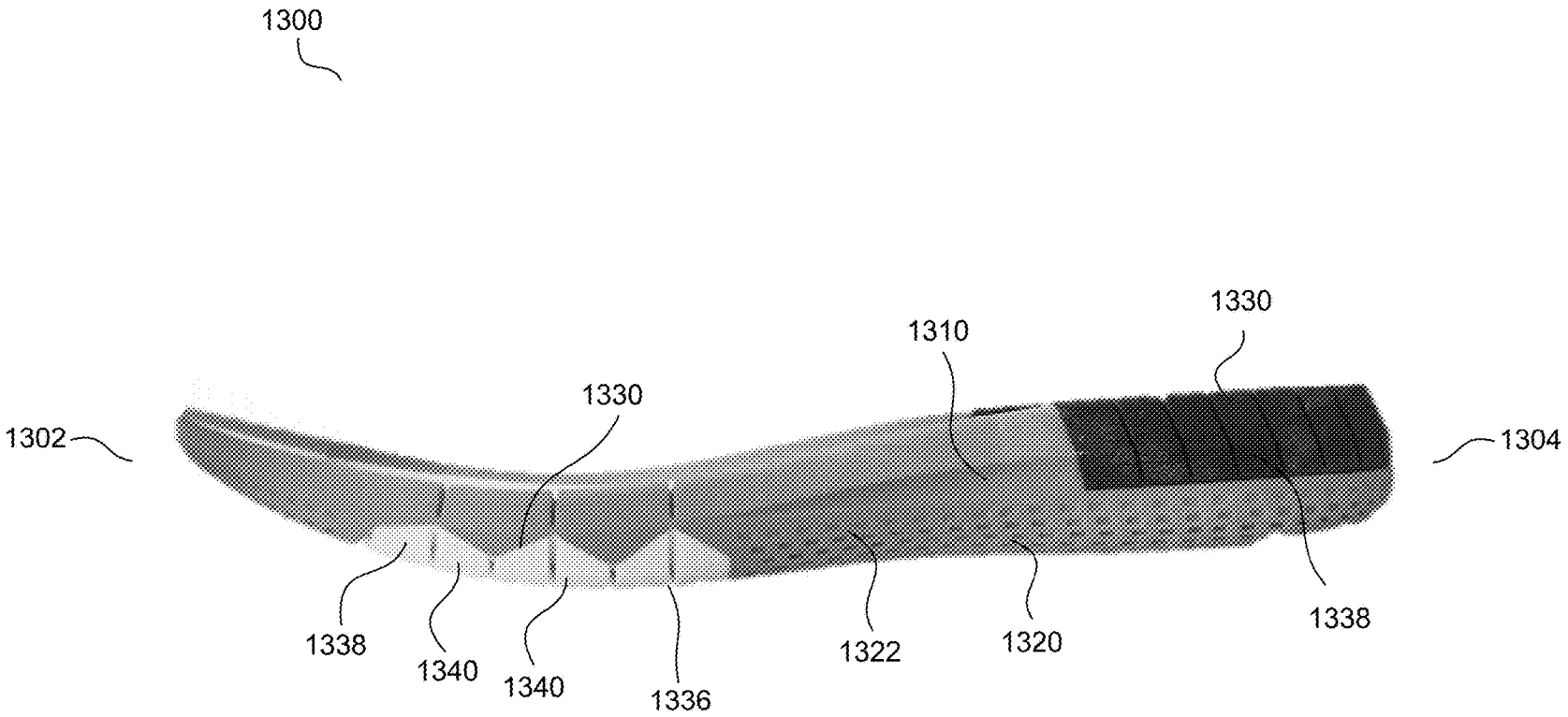

FIG. 14 is a side view of a midsole according to an embodiment.

Figure 15:
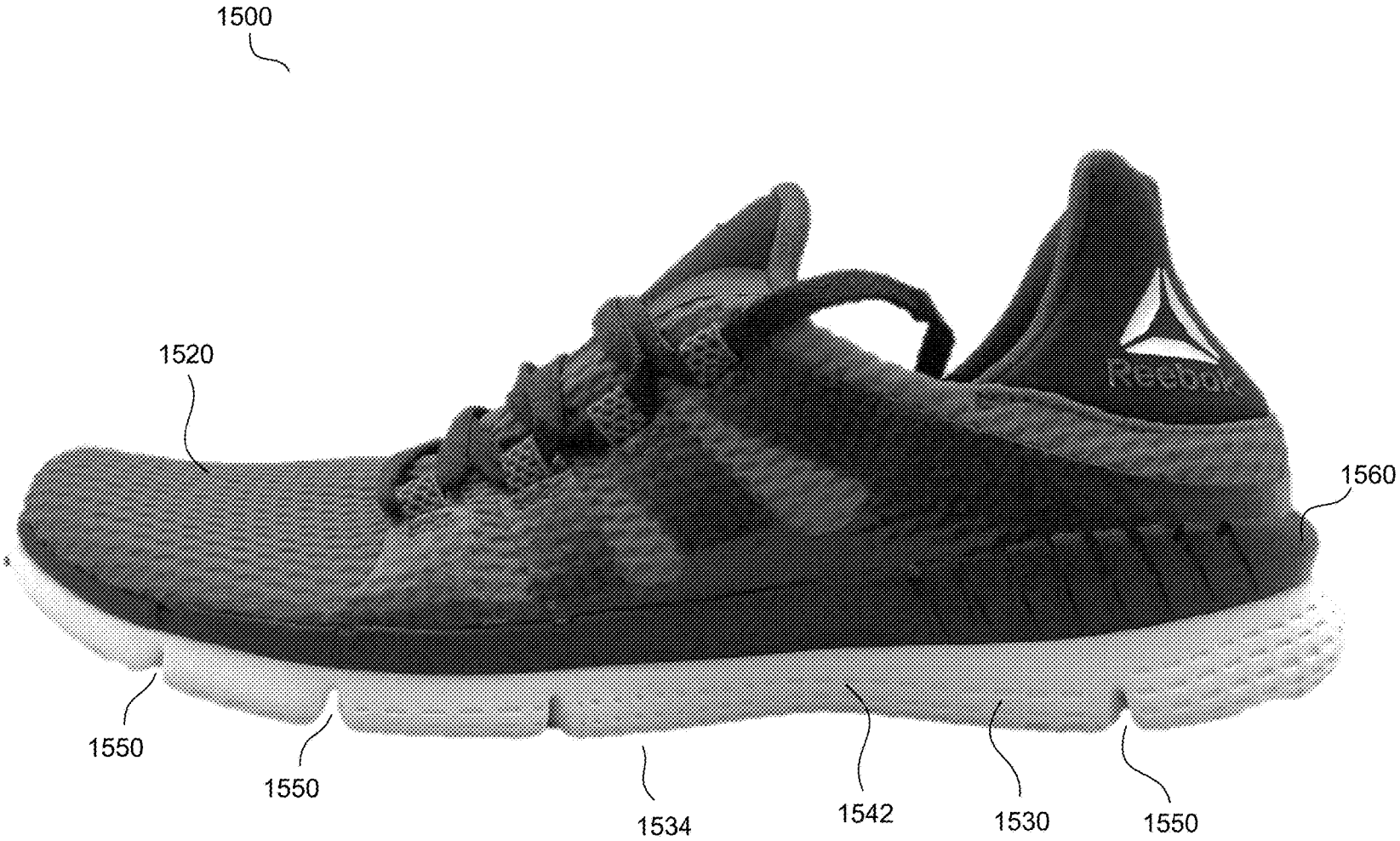

FIG. 15 is a side view of an article of footwear according to an embodiment.

Figure 16:
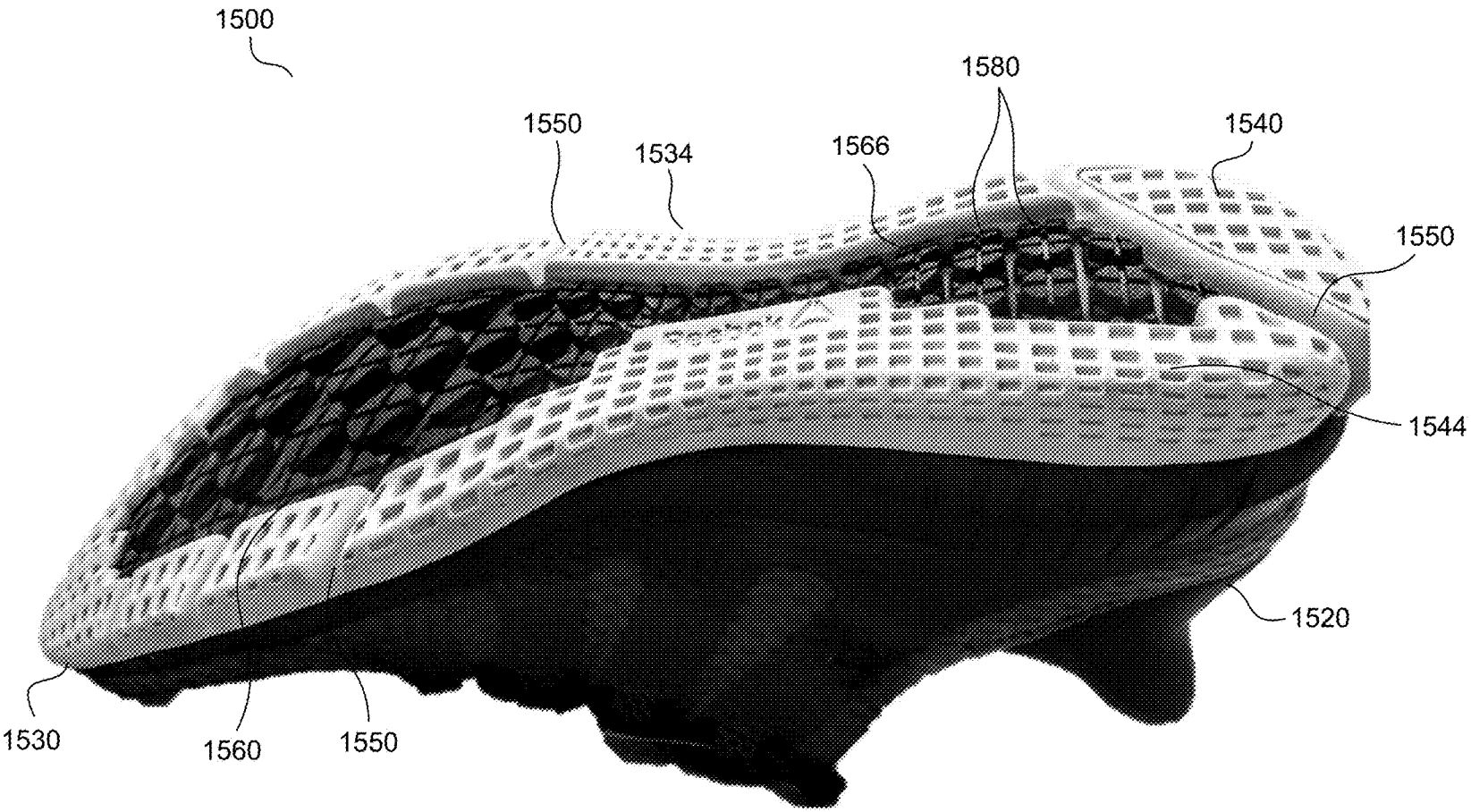

FIG. 16 is a bottom perspective view of an article of footwear according to an embodiment.

Figure 17:
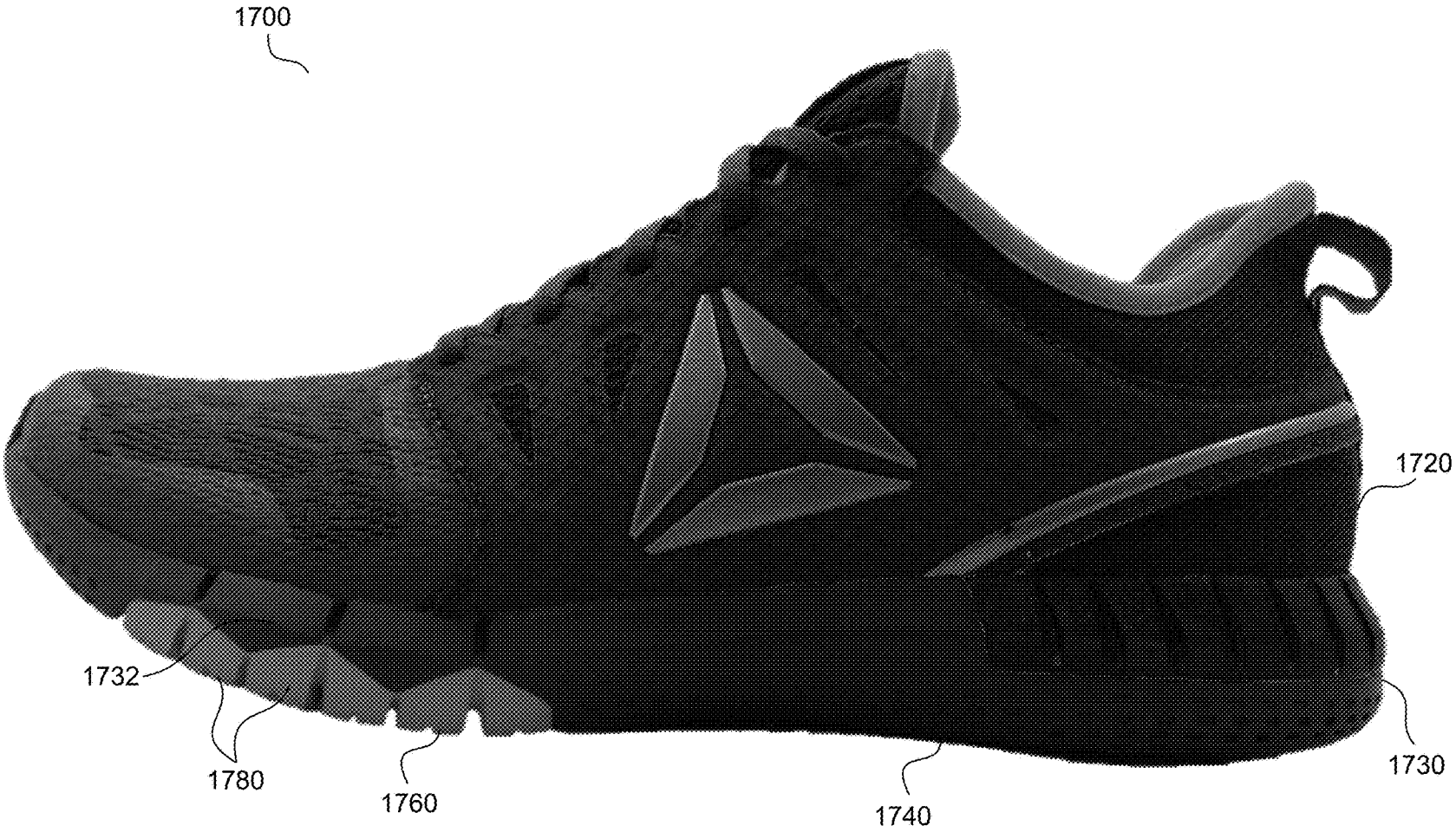

FIG. 17 is a side view of an article of footwear according to an embodiment.

Figure 18:
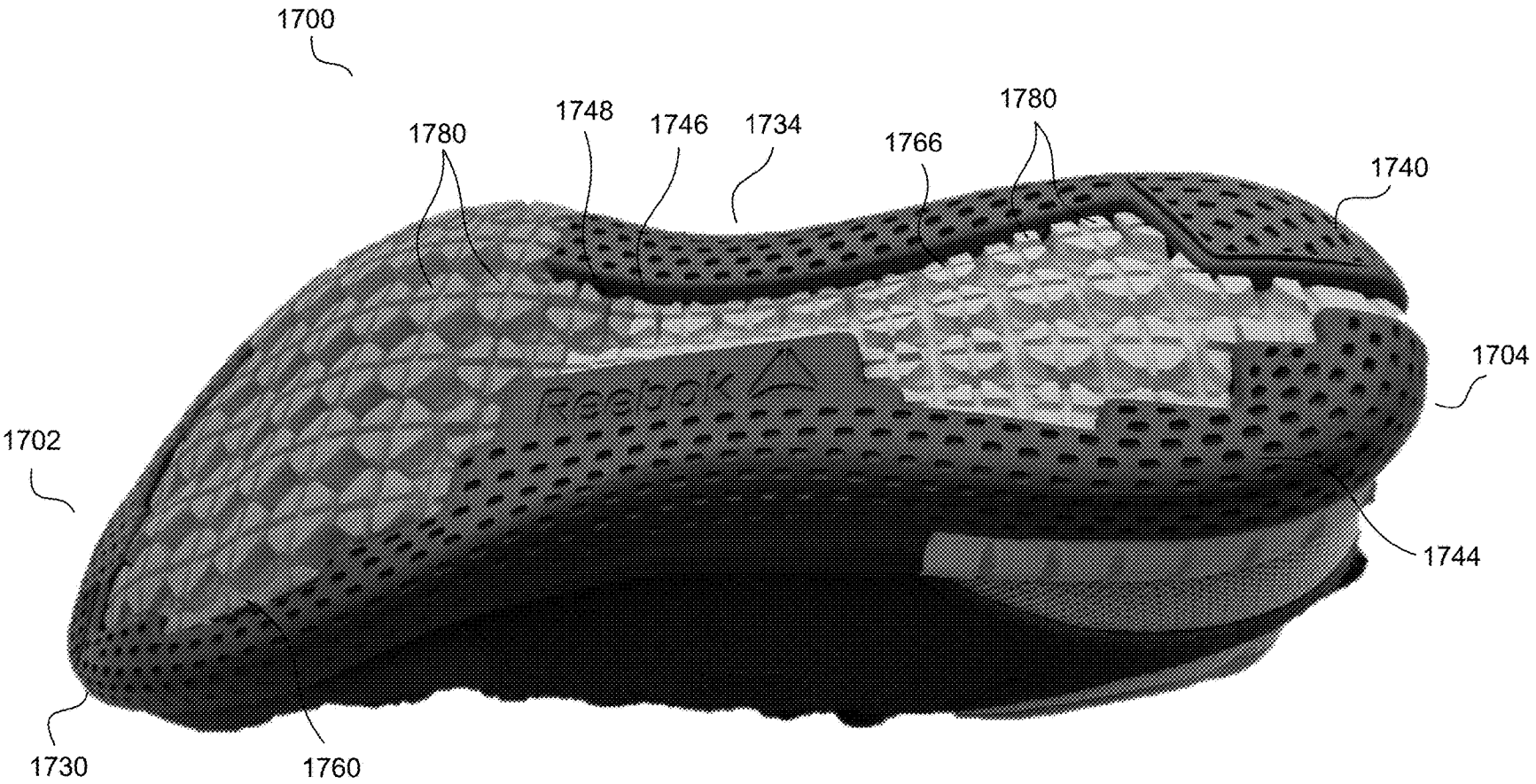

FIG. 18 is bottom perspective view of an article of footwear according to an embodiment.

Figure 19:
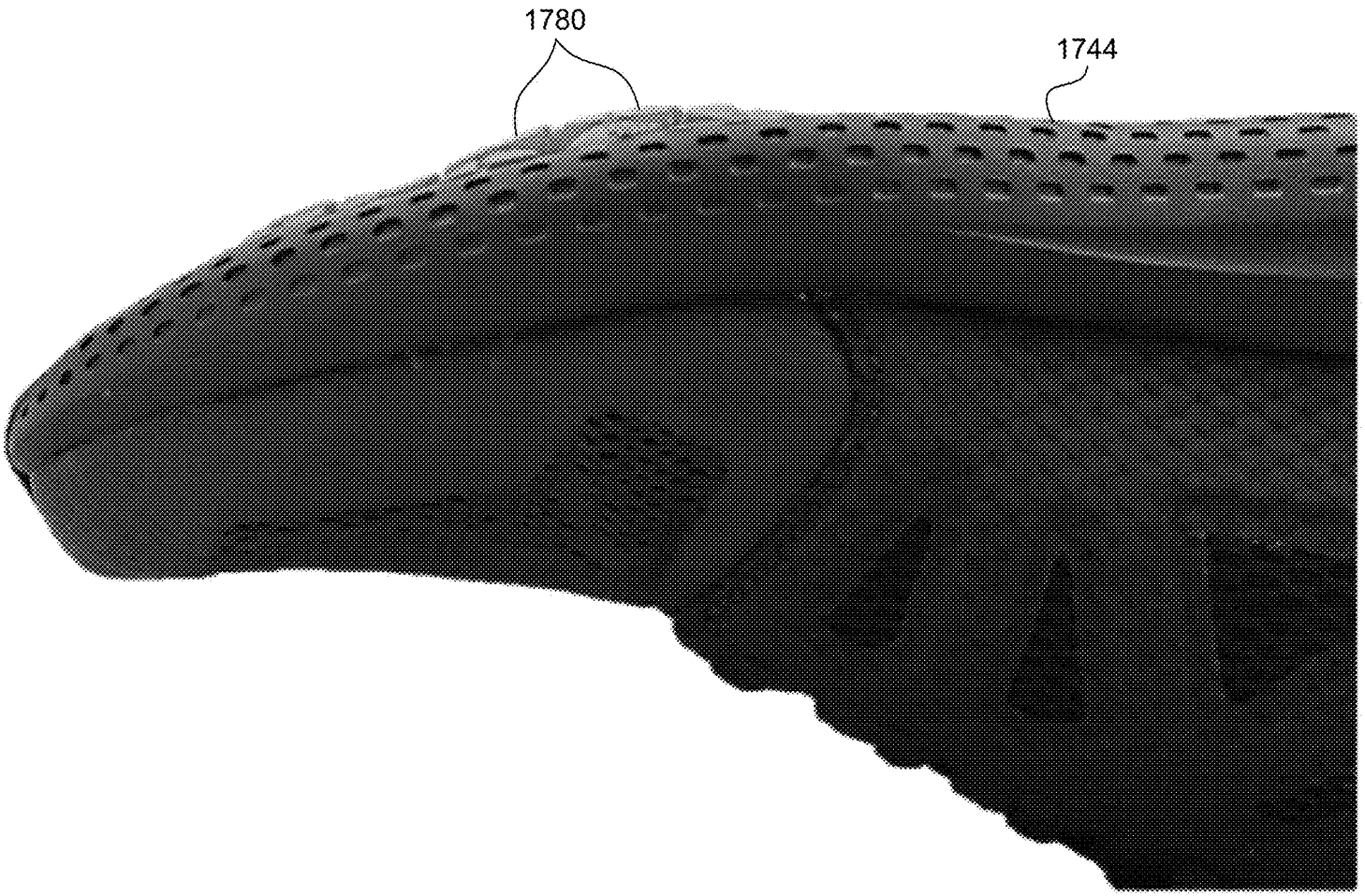

FIG. 19 is a partial side view of an article of footwear according to an embodiment.

Figure 20:
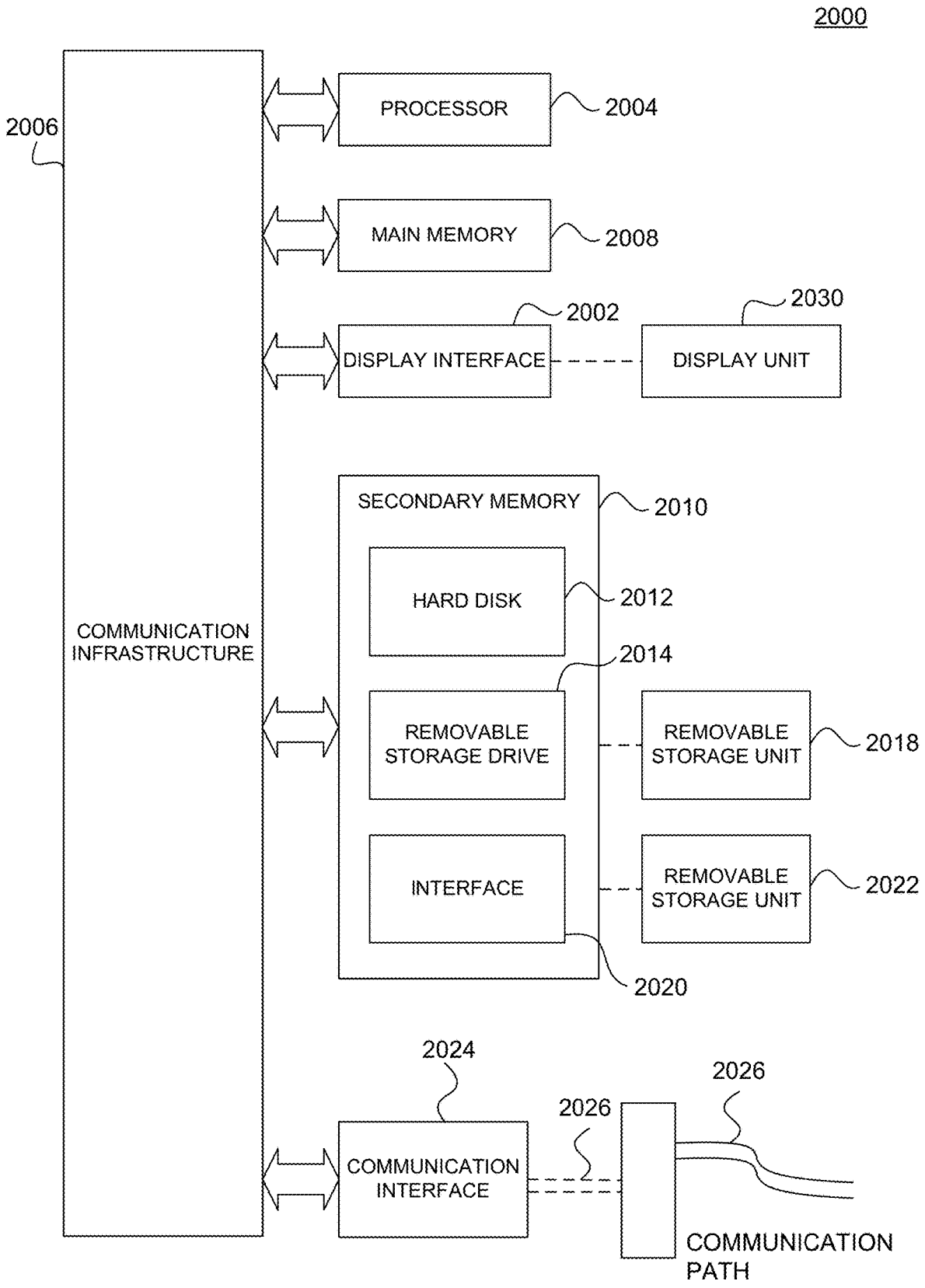

FIG. 20 is a schematic block diagram of an exemplary computer system in which embodiments may be implemented.

DETAILED DESCRIPTION OF THE INVENTION

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

When an article of footwear contacts a surface, considerable forces may act on the article of footwear and, correspondingly, a wearer's foot. Although the human foot possesses natural cushioning and rebounding characteristics, the foot alone is incapable of effectively overcoming many of the forces encountered during every day activity. The added cushioning provided by an article of footwear, and particularly the sole of the article of footwear, reduces potential discomfort for an individual. Discomfort experienced during an activity, for example, exercise, may diminish the incentive for further activity, which can be detrimental to an individual's wellbeing.

The anatomy of the human foot creates a shape and contour for the bottom of the foot that results in varying degrees of pressure (force) on the bottom of the foot when the foot is in contact with the ground (e.g., while standing still, walking, running, etc.). The varying degrees of pressure create a pressure profile having areas of relatively high pressure and areas of relatively low pressure. To provide comfort, areas of relatively high degrees of pressure may require additional cushioning compared to areas of relatively low degrees of pressure.

Moreover, the shape and contour of the bottom of different individuals' feet create different pressure profiles for different individuals. This may also be true for the left and right foot of a single individual. Accordingly, the cushioning needs for one individual's feet (or the left and right feet of a single individual) may be different.

In some embodiments, the midsoles and articles of footwear having midsoles discussed herein may have a distal surface profile based, in whole or in part, on a pressure map of pressures exerted on the bottom of a human foot when in contact with the ground. The pressure map may be a measurement of the pressures exerted on the bottom of a human foot during, for example, standing, walking, or running (e.g., a natural gait). In some embodiments, the distal surface profile may be defined, at least in part, by a plurality of cushioning projections extending from the midsole at predetermined heights, each cushioning projection having a predetermined height profile based on a pressure map. The varying heights and height profiles of the cushioning projections may be a function of the varying pressures exerted on the bottom of a human foot in contact with the ground.

Varying the height and/or height profile of individual cushioning projections may provide varying degrees of cushioning for different areas of an individual's foot. Cushioning projections having larger average heights may be used to provide increased cushioning in high pressure area (s) and cushioning projections having smaller average height may be used to provide a lesser amount of cushioning in low pressure areas. In some embodiments, cushioning projections having a larger average height (i.e., a height profile having a larger average height) may be provided in an area of relatively high pressure (e.g., the ball of the foot) compared to the cushioning projections provided in an area of relatively low pressure (e.g., the arch of the foot). In this way, appropriate amounts of cushioning for different portions of an individual's foot/feet may be provided.

In some embodiments, an article of footwear may be customized to a particular individual's foot shape, pressure profile, and contour (i.e., foot anatomy). In some embodiments, the height profiles of a plurality of cushioning projections may be based on a standard pressure map for an individual having certain characteristics, such as, a particular shoe size (or shoe size range), height, weight, or combinations thereof. In some embodiments, the height profiles of a plurality of cushioning projections may be based on a pressure map of a specific individual's foot. Customizing the distal surface profile of an article of footwear (and in particular the distal surface profile of a midsole) with a plurality of cushioning projections having predetermined height profiles based on a pressure map may provide proper cushioning and increased comfort for an individual. Also, it may allow an individual to order/buy articles of footwear customized to his or her needs. Moreover, since the pressure map for an individual may be saved, it may allow the individual to order/buy new and/or replacement articles of footwear customized to his or her needs when desired.

Figure 1:
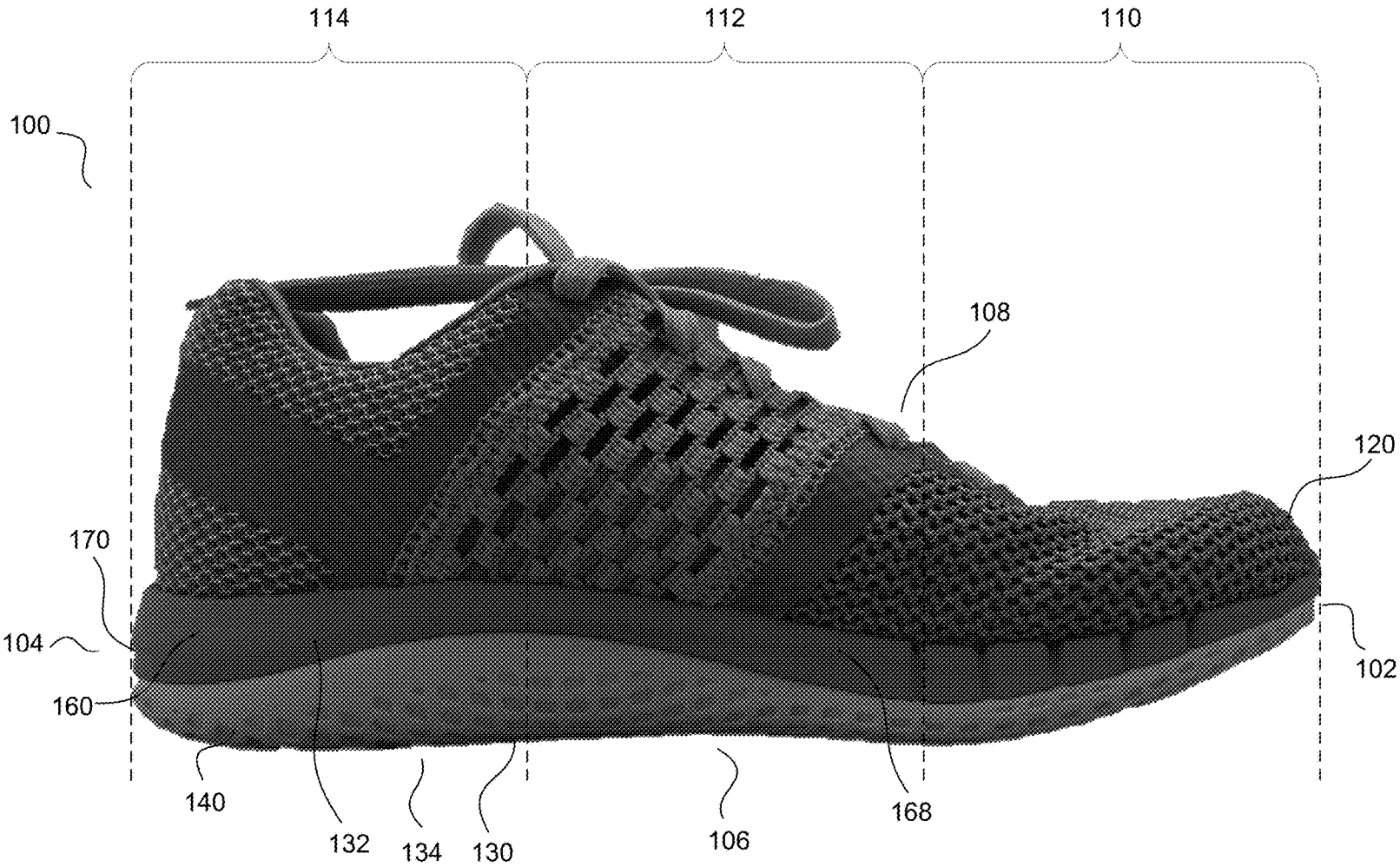
FIG. 1 is a medial side view of an article of footwear according to an embodiment.
Figure 2:
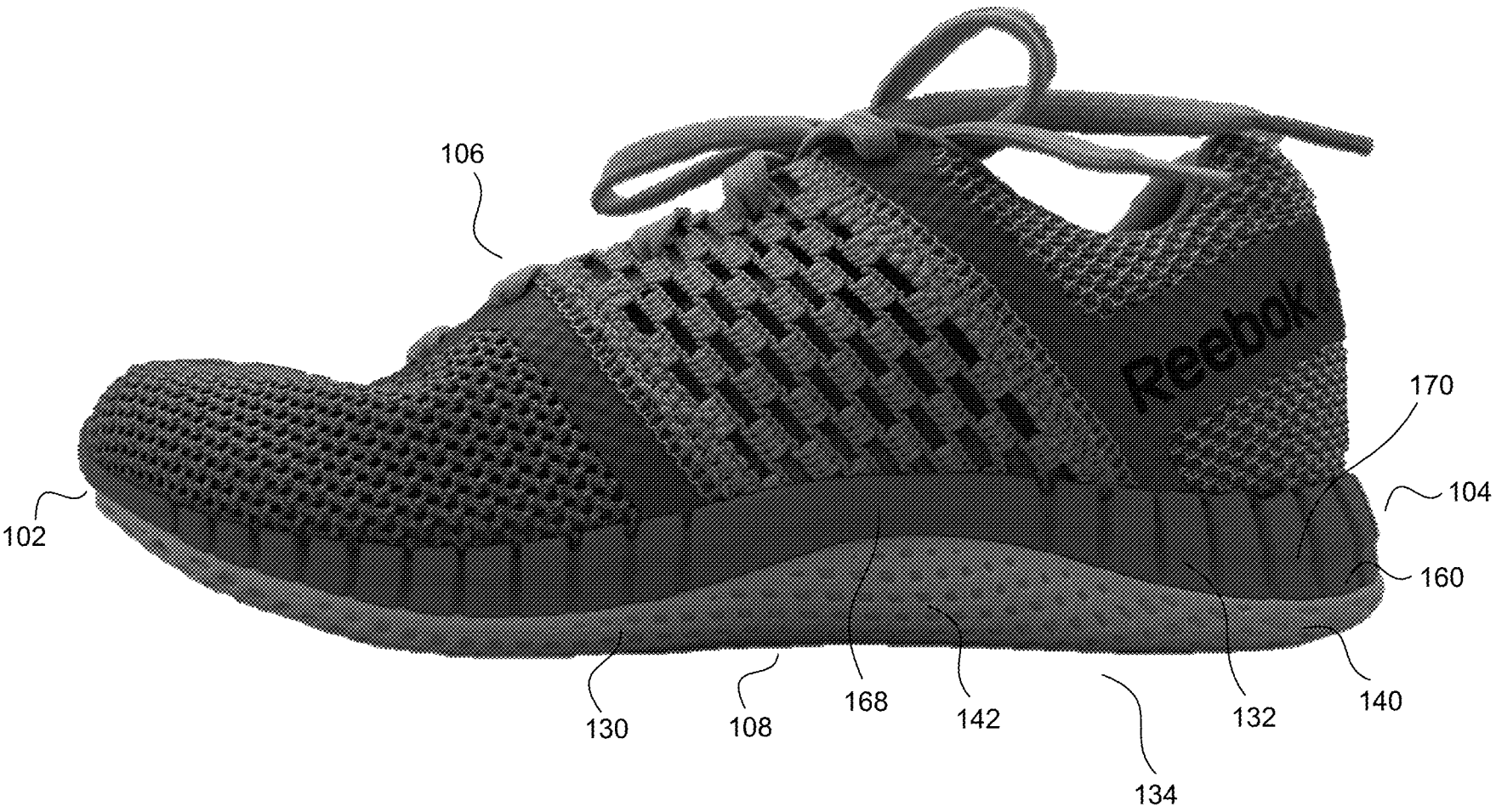
FIG. 2 is a lateral side view of an article of footwear according to an embodiment.

FIG. 1 shows an article of footwear 100 according to an embodiment. Article of footwear 100 may include an upper 120 coupled to a midsole 130. As shown in FIG. 1, article of footwear 100 includes a forefoot end 102, a heel end 104, a medial side 106, and a lateral side 108 opposite medial side 106. Also as shown in FIG. 1, article of footwear 100 includes a forefoot portion 110, a midfoot portion 112, and a heel portion 114. Portions 110, 112, and 114 are not intended to demarcate precise areas of article of footwear 100. Rather, portions 110, 112, and 114 are intended to represent general areas of article of footwear 100 that provide a frame of reference. Although portions 110, 112, and 114 apply generally to article of footwear 100, references to portions 110, 112, and 114 also may apply specifically to upper 120 or midsole 130, or individual components of upper 120 or midsole 130. In some embodiments, article of footwear 100 may include an outsole coupled to midsole 130.

Midsole 130 includes a sidewall 132 and a distal surface 134. In some embodiments, midsole 130 may include a peripheral midsole 140 (i.e., outer midsole) disposed around at least a portion of a core midsole 160 (i.e., inner midsole). In some embodiments, peripheral midsole 140 may provide lateral stability for a wearer (i.e., lateral stability for a wearer's foot when in contact with the ground). In some embodiments, peripheral midsole 140 may provide support for the arch of a wearer's foot. In some embodiments, peripheral midsole 140 may define at least a portion of sidewall 132 of midsole 130 (e.g., a peripheral sidewall 142 of peripheral midsole 140 may define at least a portion of sidewall 132). In some embodiments, peripheral midsole 140 may be directly coupled to upper 120.

Core midsole 160 may be configured to provide varying degrees of cushioning for different areas of a wearer's foot. In some embodiments, core midsole 160 may include a plurality of cushioning projections 180 having varying height profiles for providing varying degrees of cushioning. Core midsole 160 may be directly or indirectly coupled to upper 120 via, for example, but not limited to, adhesive bonding, stitching, welding, or a combination thereof. In some embodiments, core midsole 160 may be directly coupled to upper 120. In some embodiments, a sidewall 168 of core midsole 160 may be directly coupled to upper 120. In some embodiments, sidewall 168 of core midsole 160 may define at least a portion of sidewall 132 of midsole 130.

Midsole 130 and portions thereof (e.g., peripheral midsole 140 and core midsole 160) may be formed using suitable techniques, including, but not limited to, injection molding, blow molding, compression molding, and rotational molding. In some embodiments, peripheral midsole 140 and core midsole 160 may be discrete components that are formed separately and attached. In some embodiments, peripheral midsole 140 may be attached to core midsole 160 via, for example, but not limited to, adhesive bonding, stitching, welding, or a combination thereof. In some embodiments, peripheral midsole 140 may be attached to core midsole 160 via an adhesive disposed between peripheral midsole 140 and core midsole 160.

Peripheral midsole 140 and core midsole 160 may be composed of the same or different materials. In some embodiments, peripheral midsole 140 may be a single integrally formed piece. In some embodiments, core midsole 160 may be a single integrally formed piece. In some embodiments, peripheral midsole 140 and core midsole 160 may be a single integrally formed piece (formed of the same or different materials). In some embodiments, midsole 130 may be composed of only a core midsole 160. In such embodiments, core midsole 160 may perform some or all of the functions of peripheral midsole 140 discussed herein.

Midsole 130 and portions thereof (e.g., peripheral midsole 140 and core midsole 160) may comprise material(s) for providing desired cushioning, ride, and stability. Suitable materials for midsole 130 include, but are not limited to, a foam, a rubber, ethyl vinyl acetate (EVA), expanded Thermoplastic polyurethane (eTPU), Thermoplastic rubber (TPR) and a thermoplastic polyurethane (PU). In some embodiments, the foam may comprise, for example, an EVA based foam or a PU based foam and the foam may be an open-cell foam or a closed-cell foam. In some embodiments, midsole 130 may comprise elastomers, thermoplastic elastomers (TPE), foam-like plastics, and gel-like plastics.

In some embodiments, portions of midsole 130 (e.g., peripheral midsole 140, core midsole 160, or portions of peripheral midsole 140 or core midsole 160) may comprise different materials to provide different characteristics to different portions of midsole 130. In some embodiments, peripheral midsole 140 and core midsole 160 may have different hardness and/or stiffness characteristics. As a non-limiting example, core midsole 160 may be formed of a material having a lower stiffness than the material forming peripheral midsole 140. In some embodiments, the material density of peripheral midsole 140 and core midsole 160 may be different. In some embodiments, the moduli of the materials used to make peripheral midsole 140 and core midsole 160 may be different. As a non-limiting example, the material of peripheral midsole 140 may have a higher modulus than the material of core midsole 160.

In some embodiments, cushioning projections 180 may be formed of the same material of as core midsole 160. In some embodiments, cushioning projections 180 may be formed of a different material or of the same material, but with different properties (e.g., different density/hardness) as core midsole 160. In some embodiments, each cushioning projection 180 of core midsole 160 may be formed of the same material. In some embodiments, different cushioning projections 180 of core midsole 160 may be formed of a different material or of the same material, but with different properties (e.g., different density/hardness). In such embodiments, the material(s) used to make cushioning projections 180 may work in concert with the height profiles of cushioning projections 180 to provide desired amounts of support and cushioning for an individual.

Upper 120 and midsole 130 may be configured for a specific type of footwear, including, but not limited to, a running shoe, a hiking shoe, a water shoe, a training shoe, a fitness shoe, a dancing shoe, a biking shoe, a tennis shoe, a cleat (e.g., a baseball cleat, a soccer cleat, or a football cleat), a basketball shoe, a boot, a walking shoe, a casual shoe, a sandal, or a dress shoe. Moreover, midsole 130 may be sized and shaped to provide a desired combination of cushioning, stability, and ride characteristics to article of footwear 100. Desired cushioning, ride, and stability may be provided at least in part by the configuration of cushioning projections (e.g., cushioning projections 180/680) discussed herein. The term "ride" may be used herein in describing some embodiments as an indication of the sense of smoothness or flow occurring during a gait cycle including heel strike, midfoot stance, toe off, and the transitions between these stages. In some embodiments, midsole 130 may provide particular ride features including, but not limited to, appropriate control of pronation and supination, support of natural movement, support of unconstrained or less constrained movement, appropriate management of rates of change and transition, and combinations thereof.

Upper 120 may be manufactured from leather, canvas, nylon, knitted fabric, molded fabric, combinations of these materials, or other suitable materials. In some embodiments, upper 120 may include a liner, waterproofing, or other accessories. In some embodiments, upper 120 may comprise a partial foot or full foot bootie. In this manner, upper 120 may be formed without seams.

FIG. 3 shows the bottom of midsole 130 according to an embodiment. The bottom of midsole 130 may include a distal surface 134 defined by a distal most surface 144 of peripheral midsole 140 and a distal surface 166 of core midsole 160. Distal surface 166 of core midsole 160 may be defined, in whole or in part, by a plurality of cushioning projections 180 extending from an intermediate surface 164 of core midsole 160 (see e.g., FIG. 4A). In this manner, cushioning projections 180 may define a portion of distal surface 134 of midsole 130. In some embodiments, cushioning projections 180 may define the entire distal surface 134 of midsole 130, for example, in embodiments without peripheral midsole 140.

In some embodiments, core midsole 160 may include at least one cushioning projection 180 disposed in forefoot portion 110, at least one cushioning projection 180 disposed in midfoot portion 112, and at least one cushioning projection 180 disposed in heel portion 114 of midsole 130. In some embodiments, as shown for example in FIG. 3, distal surface 166 of core midsole 160 may extend from forefoot portion 110 of midsole 130 to heel portion 114 of midsole (i.e., occupy forefoot portion 110, midfoot portion 112, and heel portion 114 in a continuous fashion). In some embodiments, distal surface 166 of core midsole 160 may only occupy selected portions of distal surface 134 in a non-continuous fashion. For example, distal surface 166 may only occupy areas corresponding with the ball and heel of an individual's foot (e.g., areas corresponding to the location of posterior phalanges and metatarsals, and the calcaneus and talus, respectively).

Peripheral midsole 140 may be disposed around all or a portion of core midsole 160. In some embodiments, peripheral midsole 140 may be disposed, in whole or in part, in a recess 172 formed in core midsole 160 (see e.g., FIGS. 5A-5E). In some embodiments, peripheral midsole 140 may define at least a portion of distal surface 134 corresponding to the location of a wearer's foot arch. In some embodiments, cushioning projections 180 may be disposed within a cavity 148 defined by an inner sidewall 146 of peripheral midsole 140 (see e.g., FIGS. 5A-5E). In some embodiments, no cushioning projections 180 may extend from cavity 148 past distal most surface 144 of peripheral midsole 140. In some embodiments, one or more cushioning projections 180 may extend from cavity 148 (see e.g., cushioning projections 1780 in FIG. 19). In some embodiments, peripheral midsole 140 may have a distal most surface 144 based, in whole or in part, on a pressure map of a human foot. In some embodiments, peripheral midsole 140 may have a distal most surface 144 not based on a pressure map of a human foot.

Figure 4A:
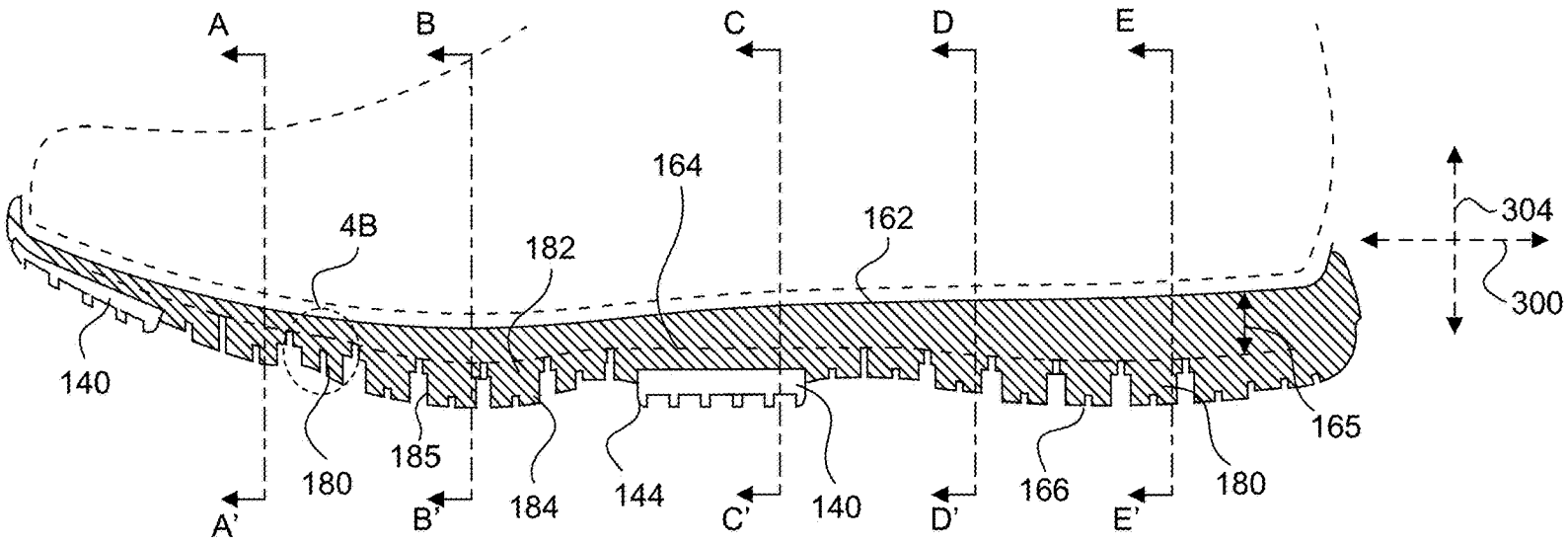
FIG. 4A is a cross-sectional view of a sole according to an embodiment along the line 4-4' in FIG. 3.

FIG. 4A shows a cross-sectional view of midsole 130 along the line 4-4' in FIG. 3. As shown in FIG. 4A, core midsole 160 may include a proximal surface 162 coupled to upper 120, an intermediate surface 164, and a plurality of cushioning projections 180 extending from intermediate surface 164 at predetermined heights (or predetermined average heights for cushioning projections 180 having a height profile that is not flat) in a vertical direction 304 substantially perpendicular to longitudinal direction 300. In some embodiments, cushioning projections 180 may have predetermined height profiles 190 that vary relative to distal most surface 144 of peripheral midsole 140. In some embodiments, one or more cushioning projections 180 may have a predetermined height profile 190 that is flat. In some embodiments, one or more cushioning projections 180 may have a predetermined height profile that vertically undulates or slopes in or more directions (e.g., longitudinal direction 300 and transverse direction 302).

As shown in FIG. 4A, the distance 165 (i.e., thickness) between intermediate surface 164 and proximal surface 162 may vary along the length of article of footwear 100 (i.e., in longitudinal direction 300). In such embodiments, the thickness of core midsole 160 between intermediate surface 164 and proximal surface 162 may work in conjunction with cushioning projections 180 to provide varying degrees of cushioning for different areas of an individual's foot. In some embodiments, all the cushioning projections 180 on a midsole 130 may have the same height and/or height profile relative to intermediate surface 164 and intermediate surface 164 may have a surface contour based, in whole or in part, on a pressure map. In such embodiments, distance 165 may vary in longitudinal direction 300 and/or transverse direction 302 based on the pressure map. Moreover, in such embodiments, the heights and/or height profiles of cushioning projections 180 may be varied relative to proximal surface 162 in a similar fashion as discussed herein with respect to intermediate surface 164.

Cushioning projections 180 may include a connection end 182 coupled to intermediate surface 164 and a free end 184 having a free end surface 186 with a height profile 190 vertically disposed from and separated from connection end 182 by a sidewall 185. The height profile 190 (and free end surface 186) of one or more cushioning projections 180 may define a portion of distal surface 166 of core midsole 160, and therefore a portion of distal surface 134 of midsole 130.

Figure 4B:
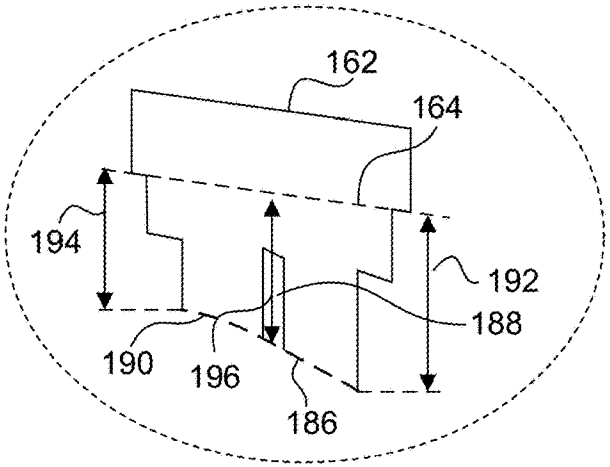
FIG. 4B shows a zoomed-in view of a portion of FIG. 4A.

As shown in FIG. 4B, a height profile 190 for a cushioning projection 180 may include a maximum height 192, a minimum height 194, and an average height 196, each measured from intermediate surface 164 (or another base surface of midsole 130) to free end surface 186 of a cushioning projection 180. In other words, every location on intermediate surface 164 may be considered to have a height of zero. Height profile 190, maximum height 192, the location of maximum height 192, minimum height 194, and the location of minimum height 194 may be based on one or more of: a pressure map of human foot, the location of a particular cushioning projection 180, the size of a particular cushioning projection 180, and the shape of a particular cushioning projection 180. In some embodiments, cushioning projections 180 may have an average height in the range of 14 mm to 6 mm. In some embodiments, cushioning projections 180 may have an average height in the range of 12 mm to 8 mm.

As exemplified in FIG. 4B, height profile 190 for a cushioning projection 180 may not necessarily be the same as a free end surface 186 of the cushioning projection 180. Height profile 190 may not include free end surface features, such as, but not limited to grooves (e.g., groove 188) and tread, located on free end surface 186 of a cushioning projection 180. In other words, height profile 190 may be defined as the overall surface profile of free end 184 of a cushioning projection 180. In embodiments with one or more cushioning projections 180 having a free end surface devoid of surface features (e.g., a smooth free end surface 186), the height profile 190 may match the free end surface 186 of the one or more cushioning projections 180.

While FIG. 4B shows an exploded view of a single cushioning projection 180 having a maximum height 192 located at one edge of height profile 190 and a minimum height 194 located on the other edge, the maximum and minimum heights need not be located on the edges of height profile 190. In some embodiments, the maximum and/or minimum height may be located interior of the edges of a height profile 190 (e.g., at the center of a height profile 190). In embodiments including a cushioning projection 180 having a flat height profile 190, maximum height 192, minimum height 194, and average height 196 are the same. Moreover, while FIG. 4B shows a 2-dimensional cross-sectional representation of height profile 190 (in longitudinal direction 300 and vertical direction 304), height profile 190 is a 3-dimensional profile that may also vary in transverse direction 302 as discussed herein. Accordingly, maximum height 192, minimum height 194, and average height 196 may dictated by any variation of height profile 190 in transverse direction 302 (i.e., into the page in FIGS. 4A and 4B).

Cushioning projections 180 may have any suitable 2-dimensional cross-sectional shape taken in a longitudinal direction 300 and transverse direction 302. Cushioning projections 180 may have a cross-sectional shape in longitudinal direction 300 and transverse direction 302 such as, but not limited to, a triangular shape, a square shape, a hexagonal shape, a circular shape, and an oval shape. In some embodiments, one or more cushioning projections 180 may have the same 2-dimensional cross-sectional shape taken in a longitudinal direction 300 and transverse direction 302. In some embodiments, one or more cushioning projections 180 may have the same 2-dimensional cross-sectional shape, but have different sizes of that shape (e.g., larger and smaller circular shapes). In some embodiments, each cushioning projection 180 on a midsole 130 may have the same 2-dimensional cross-sectional shape, but have different sizes of that shape (e.g., larger and smaller hexagonal shapes as shown in FIG. 6). Since cushioning projections 180 extend in vertical direction 304, they will have a 3-dimensional shape corresponding to their cross-sectional shape taken in a longitudinal direction 300 and transverse direction 302.

In some embodiments, cushioning projections 180 may have a height profile 190 based on a pressure map of pressures exerted on the bottom of a human foot in contact with the ground. In some embodiments, each cushioning projection 180 on midsole 130 may have a height profile 190 based on a pressure map of pressures exerted on the bottom of a human foot in contact with the ground. In some embodiments, height profile(s) 190 of cushioning projection (s) 180 located in a high pressure region of the pressure map have a larger average height 196 than the average height 196 of height profile(s) 190 of cushioning projection(s) 180 located in a low pressure region of the pressure map. In this manner, cushioning projections 180 having larger average heights may provide increased support/comfort for areas of the foot that experience relatively high degrees of pressure forces when in contact with the ground.

In some embodiments, height profiles 190 of a plurality of cushioning projections 180 may vary in one or more of longitudinal direction 300 and transverse direction 302 substantially perpendicular to longitudinal direction 300. In some embodiments, height profiles 190 of one or more cushioning projections 180 may vary as function of the pressure values exerted on the bottom of the human foot. In some embodiments, the height profiles 190 of a plurality of cushioning projections 180 may vary in longitudinal direction 300 and/or transverse direction 302 as a function of the pressure values exerted on the bottom of the human foot.

In some embodiments, the height profile 190 of a single cushioning projection 180 may vary in one or more of longitudinal direction 300 and transverse direction 302. In some embodiments, the height profile 190 of a single cushioning projection 180 may vary in longitudinal direction 300 and/or transverse direction 302 as a function of the pressure values exerted on the bottom of the human foot.

FIGS. 5A-5E are cross-sectional views along lines A-A', B-B', C-C', D-D', and E-E' in FIG. 3, respectively, and show the change in heights/height profiles of cushioning projections 180 according to an embodiment. As shown when comparing FIGS. 5A and 5B, cushioning projections 180 may increase in average height when moving from a location adjacent to the forefoot end of core midsole 160 (FIG. 5A) towards a position corresponding to the location of the ball of an individual's foot (i.e., at a position corresponding to a location near the anterior end of metatarsals 1008*a-e* (see FIG. 10)). As shown in FIG. 5C, when at a location corresponding to the arch of an individual's foot, the average height of cushioning projections 180 may be smaller than the average height of cushioning projections 180 located at the ball of the foot. Then, as shown when comparing FIGS. 5D and 5E, the average height of cushioning projections 180 may increase when moving towards a position corresponding to a location of the heel of an individual's foot (i.e., at a position corresponding to the location of calcaneus 1020 and talus 1022 (see FIG. 10)).

FIGS. 5A-5E also show cushioning projections 180 having varying average heights and height profiles in transverse direction 302. For example, as shown in FIGS. 5D and 5E, in a row of cushioning projections 180, the average height the most laterally and medially located cushioning projections 180 may be smaller than cushioning projections 180 centrally located on core midsole 160.

In some embodiments, article of footwear 100 may include a flex groove 170 running along an outer surface 167 of sidewall 168 of core midsole 160 (i.e., disposed on sidewall 168). FIGS. 5A-5E show cross-sectional views of a flex groove 170 according to an embodiment. Flex groove 170 may provide increased flexibility for midsole 130. In some embodiments, flex groove 170 may run around the entire perimeter of sidewall 168. In some embodiments, flex groove 170 may run along a portion of sidewall 168 (e.g., medial side 106 and lateral side 108 of sidewall 168). In some embodiments, at least a portion of flex groove 170 may be disposed immediately adjacent to upper 120. In some embodiments, at least a portion of flex groove 170 may be disposed in a proximal half of a height 169 of sidewall 168. In some embodiments, at least a portion of flex groove 170 may be disposed in a proximal third of height 169 of sidewall 168.

FIGS. 6-9 show an article of footwear 600 according to an embodiment. Similar to article of footwear 100, article of footwear 600 includes a forefoot end 602, a heel end 604, a medial side 606, and a lateral side 608 opposite medial side 606. Also, article of footwear 600 includes a forefoot portion, a midfoot portion, and a heel portion like article of footwear 100.

Article of footwear 600 may include an upper 620 coupled to a midsole 630. Midsole 630 may include a peripheral midsole 640 (i.e., outer midsole) disposed around at least a portion of a core midsole 660 (i.e., inner midsole). Peripheral midsole 640 may have all or a portion of the features and characteristics discussed above in regards to peripheral midsole 140. Similarly, core midsole 660 may have all or a portion of the features and characteristics discussed above in regards to core midsole 160.

Article of footwear 600 may also include a plurality of cushioning projections 680 the same as or similar to cushioning projections 180. For example, cushioning projections 680 may have height profiles 690 with maximum, minimum, and average heights as discussed above in regards to height profiles 190. In some embodiments, cushioning projections 680 may be disposed in a cavity 648 defined by an inner sidewall 646 of peripheral midsole 640. In some embodiments, core midsole 660 may include a flex groove 670 running along an outer surface of a sidewall 668 of core midsole 660. Flex groove 670 may be the same as or similar to flex groove 170.

As shown in FIG. 6, cushioning projections 680 may be arranged side-by-side in a plurality of transverse and longitudinal rows 692/694. Transverse rows 692 may extend in a substantially transverse direction (e.g., transverse direction 702 shown in FIG. 7) between medial side 606 and lateral side 608 of article of footwear 600. In some embodiments, one or more transverse rows 692 may extend straight across article of footwear 600 in transverse direction 702. In some embodiments, one or more transverse rows 692 may not extend straight across article of footwear 600 in transverse direction 702, but may have an arched or curved shape across article of footwear 600 in transverse direction 702. In some embodiments, one or more transverse rows 692 may be a continuous row of cushioning projections 680. In some embodiments, one or more transverse rows 692 may be a non-continuous row of cushioning projections 680. In such embodiments, one or more cushioning projections 680 in a transverse row 692 may be separated by a different element (e.g., a portion of peripheral midsole 140).

Longitudinal rows 694 may extend in a substantially longitudinal direction (e.g., longitudinal direction 700 shown in FIG. 7) between forefoot end 602 and heel end 604 of article of footwear 600. In some embodiments, one or more longitudinal rows 694 may extend straight along article of footwear 600 in longitudinal direction 700. In some embodiments, one or more longitudinal rows 694 may not extend straight along article of footwear 600 in longitudinal direction 700, but may have an arched or curved shape along article of footwear 600 in longitudinal direction 700. In some embodiments, one or more longitudinal rows 694 may be a continuous row of cushioning projections 680. In some embodiments, one or more longitudinal rows 694 may not be a continuous row. In such embodiments, one or more cushioning projections 680 in a longitudinal row 694 may be separated by a different element (e.g., a portion of peripheral midsole 140, as shown in FIG. 6).

The height characteristics (e.g., height profile, average height, maximum height, and minimum height) of cushioning projections 680 in rows 692/694 may be based on a pressure map of pressures exerted on the bottom of a human foot when in contact with the ground. In some embodiments, at least one longitudinal row 694 of cushioning projections 680 includes cushioning projections 680 having varying average heights and at least one transverse row 692 of cushioning projections 680 includes cushioning projections 680 having varying average heights. In some embodiments, cushioning projections 680 in a transverse row 692 (e.g., transverse row 692*b*) may each have an average height less than all the cushioning projections 680 in a transverse row 692 located on forefoot side of transverse row 692*b* (e.g., transverse row 692*a*) and a transverse row located on heel side of transverse row 692*b* (e.g., transverse row 692*d*). In some embodiments, cushioning projections 680 in a transverse row (e.g., transverse row 692*b*) may each have an average height less than all the cushioning projections 680 in adjacent transverse rows (e.g., rows 692*a* and 692*c*) on either side of the transverse row. As a non-limiting example, a transverse row 692 located at a position corresponding to the central shafts of the posterior phalanges 1006*a-e* of a wearer's foot may include cushioning projections 680 each having an average height less than all the cushioning projections 680 in adjacent transverse rows. Core midsole 660 may include this configuration because this area of wearer's foot may experience less pressure forces when in contact with the ground, compared to adjacent areas (see pressure map in FIG. 11).

Together the height profiles 690 of individual cushioning projections 680 define an undulating overall surface profile 710 (as shown, for example, in FIG. 7). Undulating overall surface profile 710 may correspond, in whole or in part, to a pressure map of pressures exerted on the bottom of a human foot when in contact with the ground. As shown in FIG. 7, undulating overall surface profile 710 may have a varying height in a vertical direction 704 relative to a distal most surface 644 of peripheral midsole 640. FIG. 7 also shows undulating overall surface profile 710 having a varying height in vertical direction 704 relative to an intermediate surface 664 of core midsole 660. While FIG. 7 shows a 2-dimensional cross-sectional representation of undulating overall surface profile 710 (in longitudinal direction 700 and vertical direction 704), undulating overall surface profile 710 is a 3-dimensional profile that may also vary in transverse direction 702.

Undulating overall surface profile 710 may include one or more valleys 712 and one or more peaks 714. The location of valleys 712 and peaks 714 may correspond to areas of low pressure and high pressure in a pressure map, respectively. In some embodiments, undulating overall surface profile 710 may include a valley 712 positioned at a location corresponding to the arch of a foot in a pressure map. In some embodiments, undulating overall surface profile 710 may include a valley 712 positioned at a location corresponding to the central shafts of the posterior phalanges of a foot in a pressure map. In some embodiments, undulating overall surface profile 710 may include a peak 714 positioned at a location corresponding to the heel of a foot in a pressure map. In some embodiments, undulating overall surface profile 710 may include a peak 714 positioned at a location corresponding to the ball of a foot in a pressure map. In some embodiments, as shown in FIG. 7, undulating overall surface profile may be a substantially smooth profile (i.e., does not including any sharp changes in slope or discontinuities). FIG. 8 shows a partial side view of article of footwear 600 showing valleys 712 and peaks 714 according to an embodiment.

FIG. 9 shows a partial bottom view of article of footwear 600 showing the details of cushioning projections 680 according to an embodiment. As shown in FIG. 9, cushioning projections 680 include a connection end 682 coupled to intermediate surface 664 of core midsole 660 and a free end 684 having a free end surface 686 defining a portion of a distal surface 666 of core midsole 660. Connection end 682 is disposed vertically from and separated from free end 684 by a sidewall 685. Together, connection end 682, free end 684, and sidewall 685 define the 3-dimensional shape of cushioning projection 680.

In some embodiments, free end 684 of one or more cushioning projections 680 may include a free end surface 686 having one or more grooves 688 disposed thereon. Grooves 688 may provide traction for distal surface 166 of core midsole 160 and therefore traction for a distal surface of midsole 630. In some embodiments, one or more cushioning projections 680 may include a free end surface 686 having one groove 688 oriented substantially in longitudinal direction 700 and another groove 688 oriented substantially in transverse direction 702 substantially perpendicular to longitudinal direction 700. In some embodiments, grooves 688 may have a depth of approximately 2 mm. In some embodiments, free end surfaces 686 of cushioning projections 680 may have additional or alternative surface features for providing traction (e.g., tread).

In some embodiments, each cushioning projection 680 may be a separate and distinct projection extending from intermediate surface 664. In other words, no portion of one cushioning projection 680 (i.e., connection end 682, free end 684, and sidewall 685) may contact any other cushioning projection 680.

FIG. 10 depicts a typical skeletal structure for a human foot 1000 with the forefoot end (i.e., anterior end) and the heel end (i.e., posterior end) labeled as 1001 and 1003, respectively. The forefoot area of human foot 1000 includes a ball area and a toe area. The toe area of human foot 1000 is generally considered to include, among other things, anterior phalanges 1002*a*, 1002*b*, 1002*c*, 1002*d*, 1002*e*, middle phalanges 1004*b*, 1004*c*, 1004*d*, 1004*e*, and the anterior heads and central shafts of posterior phalanges 1006*a*, 1006*b*, 1006*c*, 1006*d*, and 1006*e*. The ball area of human foot 1000 is generally considered to include, among other things, the posterior heads of posterior phalanges 1006*a*, 1006*b*, 1006*c*, 1006*d*, 1006*e*, and metatarsals 1008*a*, 1008*b*, 1008*c*, 1008*d*, 1008*e*. Each metatarsal 1008*a-e* is aligned with and attached via connective tissue to corresponding posterior phalanges 1006*a-e* at metatarsal-phalangeal joints 1007*a-e*. For example, first metatarsal 1008*a* is connected to posterior phalange 1006*a* of the big toe and fifth metatarsal 1008*e* is connected to posterior phalange 1006*e* of the smallest or fifth toe at metatarsal-phalangeal joints 1007*a* and 1007*e*, respectively.

A midfoot area of human foot 1000 is generally considered to include, among other things, medial cuneiform 1010, intermediate cuneiform 1012, lateral cuneiform 1014, cuboid 1016, and navicular 1018. The cuneiforms 1010, 1012, and 1014, and the cuboid 1016 facilitate interconnection of the tarsus to the metatarsus. First, second and third metatarsals 1008*a-c* are largely attached on their posterior ends to medial, intermediate and lateral cuneiforms 1010, 1012, and 1014, respectively. Fourth and fifth metatarsals 1008*d* and 1008*e* are both substantially connected to cuboid 1016.

A rearfoot area of human foot 1000 is generally considered to include, among other things, calcaneus 1020 and talus 1022. The tibia and fibula of the leg are movably attached to talus 1022 to form the ankle joint. In general, the tibia and fibula form a mortise into which a portion of talus 1022 is received to form a hinge-type joint which allows both dorsi and plantar flexion of the foot. Talus 1022 overlies and is movably interconnected to calcaneus 1020 to form the subtalar joint. The subtalar joint enables the foot to move in a generally rotative, side-to-side motion. Rearfoot pronation and supination of the foot is generally defined by movement about this joint.

FIG. 11 shows an exemplary pressure map 1100 of the pressures exerted on the bottom of two feet when in contact with the ground. Pressure map 1100 may include areas of high pressure 1102, areas of moderate pressure 1104, areas of medium pressure 1106, areas of low pressure 1108, and areas of light pressure 1110 depending on the anatomy of an individual's feet. As shown in FIG. 11, the areas of highest pressure may be associated with the ball and heel of an individual's feet while the areas of lowest pressure may be associated with the location of the central shafts of the posterior phalanges and the arch of an individual's feet. In some embodiments, pressure map 1100 may include a pressure map of only a single foot.

The size of the areas and the degree of pressures in each area (1102, 1104, 1106, 1108, and 1110) may vary depending on the anatomy of an individual's foot because weight is distributed differently across the foot for individuals with different foot anatomies. For example, an individual having a high arch will have a different distribution of pressures compared to an individual having a flat foot. In some cases, an individual with a high foot arch may have higher maximum pressure values associated with the ball and heel of his or her foot because the bottom of his or her foot has less surface area contacting the ground. In such a case, an overall undulating surface profile (e.g., 710) for that individual may have higher peaks 714 and lower valleys 712 compared to an individual with a flat foot. Table 1 below shows exemplary pressure ranges for areas of high pressure 1102, moderate pressure 1104, medium pressure 1106, low pressure 1108, and light pressure 1110 for an individual with a high arch and an individual with a flat foot. The degrees of pressure in each area may also be influenced by the weight of the individual.

TABLE 1

Exemplary Pressure Ranges for Areas of Pressure in Pressure Map 1100

| | High Arched Foot | Flat Foot |
|---|---|---|
| High Pressure | 305-240 kPa | 100-80 kPa |
| Moderate Pressure | 240-185 kPa | 80-60 kPa |
| Medium Pressure | 185-120 kPa | 60-40 kPa |
| Low Pressure | 120-65 kPa | 40-20 kPa |
| Light Pressure | 65-0 kPa | 20-0 kPa |

In some embodiments, pressure data for pressure map 1100 may be collected using an in-shoe pressure measuring system, such as but not limited to, the PEDAR® system and related software (Novel Electronics, Munich, Germany). In some embodiments, the data collected may be used to calculate one or more values, such as but not limited to, the following: 1) peak pressures for different areas of the foot (measured in e.g., kilopascals (kPa)), 2) mean peak pressures representing the average of the peak pressures for an area of the foot during an activity (e.g., walking or running) or while standing still, 3) pressure-time integrals, which are the product of a mean peak pressure and the time over which it was applied, 4) peak forces for different areas of the foot (measured in e.g., % bodyweight (BW)), 5) mean peak forces representing the average of the peak forces for an area of the foot during an activity, and 6) force-time integrals, which are the product of a mean peak force and the time over which it was applied. Areas on the foot for which these values may be calculated include, but are not limited to, the area corresponding with the heel of the foot, each area corresponding to the anterior heads of each metatarsal of the foot, the area corresponding to the hallus (i.e., big toe) of the foot, the area corresponding to the lesser toes (i.e., four smaller toes) of the foot, the medial arch of the foot, and the lateral arch of the foot.

In some embodiments, pressure map 1100 may be a standard pressure map based one or more characteristics of an individual, such as but not limited to, foot or shoe size, foot anatomy (e.g., a high arched foot or a flat foot), weight, and height. In some embodiments, pressure map 1100 may be a standard pressure map for a human foot (feet) having a particular shoe size. In some embodiments, pressure map 1100 may be a standard pressure map for a human foot having a shoe size within a particular range. In some embodiments, pressure map 1100 may be a pressure map for a specific individual. In some embodiments, pressure map 1100 may be a pressure map of a human foot measuring the pressures exerted on the bottom of the foot when standing upright.

In some embodiments, pressure map 1100 may be a composite pressure map of a human foot (feet) measuring pressures exerted on the bottom of the foot (feet) during a natural gait. In some embodiments, pressure map 1100 may be a composite pressure map of a human foot (feet) measuring pressures exerted on the bottom of the foot (feet) during walking or running. In some embodiments, pressure map 1100 may be a composite pressure map of a specific individual's foot (feet) measuring pressures exerted on the bottom of the specific individual's foot (feet) during his or her natural gait. In some embodiments, pressure map 1100 may be a composite pressure map of a specific individual's foot (feet) measuring pressures exerted on the bottom of the specific individual's foot (feet) during walking or running.

A typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". In some embodiments, obtaining a composite pressure map may include measuring pressure values at two or more selected times during a typical gait cycle. In some embodiments, obtaining a composite pressure map may include continuously measuring pressure values during a typical gait. In such embodiments, a pressure map may be used to create cushioning projections (e.g., 180/680) tailored to provide optimal cushioning during an individual's natural gait (e.g., during walking or running).

As exemplified in FIG. 11, the pressure map of two different feet may not be the same. In such cases, the cushioning/support needed for the individual feet may be different. Accordingly, footwear customized to each foot (e.g., cushioning projections customized to each foot) may be desirable.

FIG. 12 shows a flowchart of an exemplary method 1200 of manufacturing a midsole (e.g., midsole 130/630/1300) for an article of footwear according to an embodiment. In some embodiments, method 1200 may include obtaining a pressure map of pressures exerted on the bottom of a human foot in contact with the ground in step 1202. The pressure map may be any of the types of pressure maps discussed herein. In some embodiments, the pressure map may be obtained (e.g., selected) from a database of standard pressure maps. In some embodiments, the pressure map may be obtained from an on-site pressure mapping device (e.g., a kiosk or stand within a store or other point-of-sale location). In either case, the pressure map (either standard or from a specific individual) may be obtained by measuring the pressures exerted on the bottom of a human foot in contact with the ground (e.g., while standing upright or during a natural gait).

Once the pressure map is obtained or selected, the pressure map may be translated into a distal surface profile for at least a portion of a midsole (e.g., distal surfaces 166/666 of core midsoles 160/660) in step 1204. In some embodiments, translating the pressure map into a distal surface profile includes correlating pressure values to height values for height profiles (e.g., height profiles 190/690) of a plurality of cushioning projections (e.g., cushioning projections 180/680). In other words, each cushioning projection may have a predetermined height profile based on the pressure map. In some embodiments, the pressure map may be translated based on scales or algorithms stored in the memory of a computing device (e.g., memory 2008 of computer system 2000). In some embodiments, the scales and/or algorithms may factor in the properties of the material(s) from which cushioning projections and/or core midsole are to be made.

In some embodiments, translating the pressure map into a distal surface profile may include calculating one or more of: 1) peak pressures for different areas of the foot, 2) mean peak pressures for different areas of the foot, 3) pressure-time integrals for different areas of the foot, 4) peak forces for different areas of the foot, 5) mean peak forces for different areas of the foot, and 6) force-time integrals for different areas of the foot. In some embodiments, one or more of these values may be used to define a contour for a distal surface profile. For example, these values may correspond to different peaks and valleys in a distal surface profile (e.g., 710) and the remainder of the distal surface profile may be modeled using these values as reference points.

After creating or obtaining a distal surface profile, a midsole having the distal surface profile may be formed such that a plurality of cushioning projections (e.g., cushioning projections 180/680) extend from the midsole at predetermined heights in a direction substantially perpendicular to a longitudinal direction of the midsole in step 1206. Forming the midsole may include one or more of the following processes: molding (e.g., injection molding, vacuum forming, compression molding), 3-D printing, and machining. In some embodiments, a computer system may be configured to create a model to be used in a fabrication facility for forming a midsole. In some embodiments, the model may be a model of a mold to be used to form a midsole.

In some embodiments, step 1204 may be unnecessary if a particular pressure map has already be translated in the past. For example, if the pressure map selected in step 1202 is a standard pressure map, its translated distal surface profile may be stored in the memory of a computing device.

In such embodiments, steps 1202 and 1204 may be essentially combined into a single step of obtaining a translated pressure map.

FIGS. 13 and 14 show a midsole 1300 according to an embodiment. Midsole 1300 may include a peripheral midsole 1320 (i.e., outer midsole) disposed around at least a portion of a core midsole 1330 (i.e., inner midsole). The bottom of midsole 1300 may include a distal surface 1312 defined by a distal most surface 1324 of peripheral midsole 1320 and a distal surface 1336 of core midsole 1330. Peripheral midsole 1320 may have all or a portion of the features and characteristics discussed above in regards to peripheral midsoles 140 and 640. Similarly, core midsole 1330 may have all or a portion of the features and characteristics discussed above in regards to core midsoles 160 and 660.

Midsole 1300 may include a plurality of cushioning projections 1340. Distal surface 1336 of core midsole 1330 may be defined, in whole or in part, by a plurality of cushioning projections 1340 extending from an intermediate surface 1334 of core midsole 1330. Cushioning projections 1340 may be the same as or similar to cushioning projections 180 or 680. For example, cushioning projections 1340 may have height profiles with maximum, minimum, and average heights as discussed above in regards to height profiles 190. In some embodiments, cushioning projections 1340 may be disposed in a cavity 1328 defined by an inner sidewall 1326 of peripheral midsole 1320.

In some embodiments, a sidewall 1338 of core midsole 1330 may define a portion of sidewall 1310 of midsole 1300. For example, sidewall 1338 may define a portion of sidewall 1310 at or adjacent a forefoot end 1302 of midsole 1300 (see e.g., FIG. 14). In some embodiments, a portion of one or more cushioning projections 1340 may define a portion of sidewall 1310. In some embodiments core midsole 1330 may include one or more rows of cushioning projections 1340 extending from a medial side 1306 of midsole 1300 to a lateral side 1308 of midsole 1300 (see e.g., FIG. 13). In some embodiments, peripheral midsole 1320 may define at least a portion of sidewall 1310 of midsole 1300 (e.g., a peripheral sidewall 1322 of peripheral midsole 1320 may define at least a portion of sidewall 1310)

In some embodiments, core midsole 1330 may comprise two or more different materials (e.g., two different foam materials) or the same material but with different properties (e.g., the same foam material, but with different density/hardness). In some embodiments, different areas of core midsole 1330 may be composed of different materials or of the same material but with different properties. For example, as shown in FIG. 13, an area adjacent to forefoot end 1302 (light colored area) of core midsole 1330 may be composed of a first material and an area adjacent to a heel end 1304 (dark colored area) of core midsole 1330 may be composed of a second material. Different materials of core midsole 1330 may provide different characteristics to different portions of core midsole 1330 and therefore midsole 1300 (e.g., for providing different degrees of cushioning or for providing desired ride characteristics).

FIGS. 15 and 16 show an article of footwear 1500 according to an embodiment. Article of footwear 1500 may include an upper 1520 coupled to a midsole 1530. Upper 1520 may be the same as or similar to upper 120.

Midsole 1530 may include a peripheral midsole 1540 (i.e., outer midsole) disposed around at least a portion of a core midsole 1560 (i.e., inner midsole). The bottom of midsole 1530 may include a distal surface 1534 defined by a distal most surface 1544 of peripheral midsole 1540 and a distal surface 1566 of core midsole 1560. Peripheral midsole 1540 may have all or a portion of the features and characteristics discussed above in regards to peripheral midsoles 140 and 640. Similarly, core midsole 1560 may have all or a portion of the features and characteristics discussed above in regards to core midsoles 160 and 660.

Midsole 1530 may include a plurality of cushioning projections 1580. Distal surface 1566 of core midsole 1560 may be defined, in whole or in part, by a plurality of cushioning projections 1580 extending from an intermediate surface of core midsole 1560. Cushioning projections 1580 may be the same as or similar to cushioning projections 180 or 680. For example, cushioning projections 1580 may have height profiles with maximum, minimum, and average heights as discussed above in regards to height profiles 190. In some embodiments, cushioning projections 1580 may be disposed in a cavity defined by an inner sidewall of peripheral midsole 1540.

In some embodiments, peripheral midsole 1540 may include one or more grooves 1550 formed in distal most surface 1544 of peripheral midsole 1540. In some embodiments, grooves 1550 may provide increased flexibility for peripheral midsole 1540 and therefore increased flexibility for midsole 1530. In some embodiments grooves 1550 may extend in a direction between a medial side of midsole 1530 and a lateral side of midsole 1530. In some embodiments, grooves 1550 may be formed in a peripheral sidewall 1542 of peripheral midsole 1540. In some embodiments, peripheral midsole 1540 may include a plurality of grooves 1550 disposed in a forefoot portion of midsole 1530.

In some embodiments, peripheral midsole 1540 may include grooves 1550 disposed on a medial side of peripheral midsole 1540 and grooves 1550 disposed a lateral side of peripheral midsole 1540. In some embodiments, one or more grooves 1550 disposed on the medial side of peripheral midsole 1540 may be aligned with a corresponding groove 1550 on the lateral side of peripheral midsole 1540, and vice versa (e.g., corresponding grooves 1550 may be located on opposite sides of core midsole 1560). In some embodiments, one or more grooves 1550 may align with a space between adjacent transverse rows of cushioning projections 1580. In some embodiments, corresponding grooves 1550 located on opposite sides of core midsole 1560 may be aligned with each other and a space between adjacent transverse rows of cushioning projections 1580. In some embodiments, one or more grooves 1550 may extend from a lateral side of peripheral midsole 1540 to a medial side of peripheral midsole.

FIGS. 17-19 show an article of footwear 1700 according to an embodiment. Article of footwear 1700 may include an upper 1720 coupled to a midsole 1730. Upper 1720 may be the same as or similar to upper 120.

Midsole 1730 may include a peripheral midsole 1740 (i.e., outer midsole) disposed around at least a portion of a core midsole 1760 (i.e., inner midsole). The bottom of midsole 1730 may include a distal surface 1734 defined by a distal most surface 1744 of peripheral midsole 1740 and a distal surface 1766 of core midsole 1760. Peripheral midsole 1740 may have all or a portion of the features and characteristics discussed above in regards to peripheral midsoles 140 and 640. Similarly, core midsole 1760 may have all or a portion of the features and characteristics discussed above in regards to core midsoles 160 and 660.

Midsole 1730 may include a plurality of cushioning projections 1780. Distal surface 1766 of core midsole 1760 may be defined, in whole or in part, by a plurality of cushioning projections 1780 extending from an intermediate surface of core midsole 1760. Cushioning projections 1780 may be the same as or similar to cushioning projections 180 or 680. For example, cushioning projections 1780 may have height profiles with maximum, minimum, and average heights as discussed above in regards to height profiles 190. In some embodiments, cushioning projections 1780 may be disposed in a cavity defined by an inner sidewall of peripheral midsole 1740.

In some embodiments, a portion of one or more cushioning projections 1780 may define a portion of a sidewall 1732 of midsole 1730. In some embodiments, a portion of one or more cushioning projections 1780 may define a portion of sidewall 1732 on a lateral side of midsole 1730. In some embodiments, one or more cushioning projections 1780 may define a portion of sidewall 1732 on a medial side of midsole 1730. In some embodiments, cushioning projections 1780 may be disposed within a cavity 1748 defined by an inner sidewall 1746 of peripheral midsole 1740. In some embodiments, as shown for example in FIG. 19, one or more cushioning projections 1780 may extend from cavity 1748 past distal most surface 1744 of peripheral midsole 1740.

In some embodiments, core midsole 1760 may comprise two or more different materials (e.g., two different foam materials) or the same material but with different properties (e.g., the same foam material, but with different density/hardness). In some embodiments, different areas of core midsole 1730 may be composed of different materials or of the same material but with different properties. For example, as shown in FIG. 18, an area adjacent to forefoot end 1702 (light colored area) of core midsole 1730 may be composed of a first material and an area adjacent to a heel end 1704 (dark colored area) of core midsole 1760 may be composed of a second material. Different materials of core midsole 1760 may provide different characteristics to different portions of core midsole 1760 and therefore midsole 1730 (e.g., for providing different degrees of cushioning or for providing desired ride characteristics).

One or more aspects of the methods of manufacturing a midsole for an article of footwear discussed herein, or any part(s) or function(s) thereof, may be implemented using hardware, software modules, firmware, tangible computer readable media having instructions stored thereon, or a combination thereof and may be implemented in one or more computer systems or other processing systems.

FIG. 20 illustrates an exemplary computer system 2000 in which embodiments, or portions thereof, may be implemented as computer-readable code. For example, aspects of the methods discussed herein that may be implemented in one or more computer systems include, but are not limited to, obtaining/selecting a pressure map, translating the pressure map into a distal surface profile for a midsole, obtaining an already translated pressure map, modeling a midsole, and modeling a mold for a midsole may be implemented in computer system 2000 using hardware, software, firmware, tangible computer readable media having instructions stored thereon, or a combination thereof and may be implemented in one or more computer systems or other processing systems.

If programmable logic is used, such logic may execute on a commercially available processing platform or a special purpose device. One of ordinary skill in the art may appreciate that embodiments of the disclosed subject matter can be practiced with various computer system configurations, including multi-core multiprocessor systems, minicomputers, and mainframe computers, computer linked or clustered with distributed functions, as well as pervasive or miniature computers that may be embedded into virtually any device.

For instance, at least one processor device and a memory may be used to implement the above described embodiments. A processor device may be a single processor, a plurality of processors, or combinations thereof. Processor devices may have one or more processor "cores."

Various embodiments of the inventions may be implemented in terms of this example computer system 2000. After reading this description, it will become apparent to a person skilled in the relevant art how to implement one or more of the inventions using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

Processor device 2004 may be a special purpose or a general purpose processor device. As will be appreciated by persons skilled in the relevant art, processor device 2004 may also be a single processor in a multi-core/multiprocessor system, such system operating alone, or in a cluster of computing devices operating in a cluster or server farm. Processor device 2004 is connected to a communication infrastructure 2006, for example, a bus, message queue, network, or multi-core message-passing scheme.

Computer system 2000 also includes a main memory 2008, for example, random access memory (RAM), and may also include a secondary memory 2010. Secondary memory 2010 may include, for example, a hard disk drive 2012, or removable storage drive 2014. Removable storage drive 2014 may include a floppy disk drive, a magnetic tape drive, an optical disk drive, a flash memory, a Universal Serial Bus (USB) drive, or the like. The removable storage drive 2014 reads from and/or writes to a removable storage unit 2018 in a well-known manner. Removable storage unit 2018 may include a floppy disk, magnetic tape, optical disk, etc. which is read by and written to by removable storage drive 2014. As will be appreciated by persons skilled in the relevant art, removable storage unit 2018 includes a computer usable storage medium having stored therein computer software and/or data.

Computer system 2000 (optionally) includes a display interface 2002 (which can include input and output devices such as keyboards, mice, etc.) that forwards graphics, text, and other data from communication infrastructure 2006 (or from a frame buffer not shown) for display on display unit 2030.

In alternative implementations, secondary memory 2010 may include other similar means for allowing computer programs or other instructions to be loaded into computer system 2000. Such means may include, for example, a removable storage unit 2022 and an interface 2020. Examples of such means may include a program cartridge and cartridge interface (such as that found in video game devices), a removable memory chip (such as an EPROM, or PROM) and associated socket, and other removable storage units 2022 and interfaces 2020 which allow software and data to be transferred from the removable storage unit 2022 to computer system 2000.

Computer system 2000 may also include a communication interface 2024.

Communication interface 2024 allows software and data to be transferred between computer system 2000 and external devices. Communication interface 2024 may include a modem, a network interface (such as an Ethernet card), a communication port, a PCMCIA slot and card, or the like. Software and data transferred via communication interface 2024 may be in the form of signals, which may be electronic, electromagnetic, optical, or other signals capable of being received by communication interface 2024. These signals may be provided to communication interface 2024 via a communication path 2026. Communication path 2026 carries signals and may be implemented using wire or cable, fiber optics, a phone line, a cellular phone link, an RF link or other communication channels.

In this document, the terms "computer program medium" and "computer usable medium" are used to generally refer to media such as removable storage unit 2018, removable storage unit 2022, and a hard disk installed in hard disk drive 2012. Computer program medium and computer usable medium may also refer to memories, such as main memory 2008 and secondary memory 2010, which may be memory semiconductors (e.g. DRAMs, etc.).

Computer programs (also called computer control logic) are stored in main memory 2008 and/or secondary memory 2010. Computer programs may also be received via communication interface 2024. Such computer programs, when executed, enable computer system 2000 to implement the embodiments as discussed herein. In particular, the computer programs, when executed, enable processor device 2004 to implement the processes of the embodiments discussed here. Accordingly, such computer programs represent controllers of the computer system 2000. Where the embodiments are implemented using software, the software may be stored in a computer program product and loaded into computer system 2000 using removable storage drive 2014, interface 2020, and hard disk drive 2012, or communication interface 2024.

Embodiments of the inventions also may be directed to computer program products comprising software stored on any computer useable medium. Such software, when executed in one or more data processing device, causes a data processing device(s) to operate as described herein. Embodiments of the inventions may employ any computer useable or readable medium. Examples of computer useable mediums include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nanotechnological storage device, etc.).

Some embodiments may include an article of footwear including an upper, a midsole coupled to the upper having a forefoot end disposed opposite a heel end in a longitudinal direction; the midsole including a proximal surface coupled to the upper, an intermediate surface, and a plurality of cushioning projections extending from the intermediate surface at predetermined heights in a vertical direction substantially perpendicular to the longitudinal direction, each cushioning projection having a predetermined height profile defining a portion of a distal surface of the midsole, where the predetermined height profiles of the cushioning projections are based on a pressure map of pressures exerted on the bottom of a human foot in contact with the ground.

In any of the various embodiments discussed herein, a midsole may include a peripheral midsole disposed around at least a portion of a core midsole, the core midsole including the plurality of cushioning projections extending from the intermediate surface.

In any of the various embodiments discussed herein, the predetermined height profiles of cushioning projections may vary relative to a distal most surface of a peripheral midsole. In any of the various embodiments discussed herein, the predetermined height profile of a cushioning projection located in a high pressure region of a pressure map may have a larger average height than the average height of a predetermined height profile of a cushioning projection located in a low pressure region of a pressure map.

In any of the various embodiments discussed herein, the predetermined height profiles of cushioning projections may vary as function of pressure values exerted on the bottom of the human foot as measured in a pressure map.

In any of the various embodiments discussed herein, the predetermined height profiles of cushioning projections may vary in one or more of a longitudinal direction and a transverse direction substantially perpendicular to the longitudinal direction. In any of the various embodiments discussed herein, the predetermined height profile of a single cushioning projection may vary in one or more of a longitudinal direction and a transverse direction substantially perpendicular to the longitudinal direction as a function of the pressure values exerted on the bottom of the human foot as measured in a pressure map. In any of the various embodiments discussed herein the predetermined height of a single cushioning projection may vary in one or more of a longitudinal direction and a transverse direction substantially perpendicular to the longitudinal direction.

In any of the various embodiments discussed herein, the predetermined height profiles of cushioning projections may define an undulating overall surface profile corresponding to a pressure map. In any of the various embodiments discussed herein, the undulating overall surface profile is substantially smooth. In any of the various embodiments discussed herein, the undulating overall surface profile may include one or more valleys and one or more peaks. In any of the various embodiments discussed herein, the undulating overall surface profile may include a valley positioned at a location corresponding to the arch of a foot in the pressure map. In any of the various embodiments discussed herein, the undulating surface profile may include a valley positioned at a location corresponding to the center of the posterior phalanges of a foot in the pressure map.

In any of the various embodiments discussed herein, a plurality of cushioning projections may be formed of the same material.

In any of the various embodiments discussed herein, a core midsole may be a single integrally formed piece.

In any of the various embodiments discussed herein, a core midsole and a peripheral midsole may be formed of different materials. In any of the various embodiments discussed herein, a core midsole may be formed of a material having a first stiffness and a peripheral midsole may be formed of a material having a second stiffness, where the first stiffness is less than the second stiffness.

In any of the various embodiments discussed herein, a midsole may include at least one cushioning projection disposed in a forefoot portion, at least one cushioning projection disposed in a midfoot portion, and at least one cushioning projection disposed in a heel portion of the midsole.

In any of the various embodiments discussed herein, a peripheral midsole may be disposed within a recess defined by a core midsole. In any of the various embodiments discussed herein, a peripheral midsole may be configured to provide lateral support for a wearer's foot.

In any of the various embodiments discussed herein, a midsole may include a sidewall coupled to an upper. In any of the various embodiments discussed herein, a sidewall of a midsole may include a flex groove running along an outer surface of the sidewall and configured to provide flexibility for the midsole. In any of the various embodiments discussed herein, at least a portion of the flex groove may be disposed immediately adjacent to an upper. In any of the various embodiments discussed herein, at least a portion of the flex groove may be disposed in a proximal half of a height of the sidewall. In any of the various embodiments discussed herein, at least a portion of the flex groove may be disposed in a proximal third of a height of the sidewall.

In any of the various embodiments discussed herein, a plurality of cushioning projections may be disposed side-by-side. In any of the various embodiments discussed herein, a plurality of cushioning projections may be arranged in rows. In any of the various embodiments discussed herein, a plurality of cushioning projections may have substantially the same shape. In any of the various embodiments discussed herein, a plurality of cushioning projections may have a 3-dimensional polygonal shape.

In any of the various embodiments discussed herein, a plurality of cushioning projections may include a connection end coupled to an intermediate surface of a midsole and a free end having a predetermined height profile vertically disposed from the free end, and the free end may include a surface having one or more grooves disposed thereon. In any of the various embodiments discussed herein, one or more grooves on a free end of a cushioning projection may include one groove oriented substantially in a longitudinal direction and another groove oriented in a transverse direction substantially perpendicular to the longitudinal direction.

In any of the various embodiments discussed herein, a plurality of cushioning projections may be separate and distinct projections extending from an intermediate surface.

Some embodiments may include a midsole for an article of footwear, the midsole having a forefoot end disposed opposite a heel end in a longitudinal direction and an outer midsole disposed around at least a portion of an inner midsole, the inner midsole including a proximal surface, an intermediate surface, and a plurality of cushioning projections arranged in longitudinal and transverse rows and extending from the intermediate surface in a vertical direction substantially perpendicular to the longitudinal direction, each of the cushioning projections having an average height and a height profile defining a portion of a distal surface of the midsole, where at least one longitudinal row of cushioning projections includes cushioning projections having varying average heights, and where at least one transverse row of cushioning projections includes cushioning projections having varying average heights.

In any of the various embodiments discussed herein, a midsole may include a transverse row of cushioning projections each having an average height less than all the cushioning projections in a transverse row located on a forefoot side of the transverse row and a transverse row located on a heel side of the transverse row. In any of the various embodiments discussed herein, a midsole may include a transverse row of cushioning projections each having an average height less than all the cushioning projections in adjacent transverse rows on either side of the transverse row.

In any of the various embodiments discussed herein, average heights of cushioning projections may vary relative to a distal most surface of an outer midsole. In any of the various embodiments discussed herein, the height of a single cushioning projection may vary in one or more of a longitudinal direction and a transverse direction substantially perpendicular to the longitudinal direction.

In any of the various embodiments discussed herein, an outer midsole may define at least a portion of a side wall of a midsole. In any of the various embodiments discussed herein, a flex groove formed in the sidewall of a midsole.

In any of the various embodiments discussed herein, an outer midsole may define a hollow cavity and a plurality of cushioning projections may be disposed in the hollow cavity.

Some embodiments may include a method of manufacturing a midsole for an article of footwear, the method including forming a midsole such that a plurality of cushioning projections extend from the midsole at predetermined heights in a direction substantially perpendicular to a longitudinal direction of the midsole, each cushioning projection having a predetermined height profile based on a pressure map of pressures exerted on the bottom of a human foot when in contact with the ground.

In any of the various embodiments discussed herein, a pressure map may be a standard pressure map for a human foot having a particular shoe size. In any of the various embodiments discussed herein, a pressure map may be a standard pressure map for a human foot having a shoe size within a particular range. In any of the various embodiments discussed herein, a pressure map may be a pressure map for a specific individual.

In any of the various embodiments discussed herein, a pressure map may be a pressure map of a human foot measuring the pressures exerted on the bottom of the foot when standing upright. In any of the various embodiments discussed herein, a pressure map may be a composite pressure map of a human foot measuring pressures exerted on the bottom of the foot during a natural gait. In any of the embodiments discussed herein, a pressure map may be a composite pressure map of a specific individual's foot measuring pressures exerted on the bottom of the specific individual's foot during his or her natural gait.

In any of the various embodiments discussed herein, forming a midsole may include one or more or more of the following processes: injection molding, 3-D printing, and machining.

Some embodiments may include a method of manufacturing a midsole for an article of footwear, the method including obtaining a pressure map of pressures exerted on the bottom of a human foot in contact with the ground, translating the pressure map into a distal surface profile for a midsole, and forming a midsole such that a plurality of cushioning projections extend from the midsole at predetermined heights in a direction substantially perpendicular to a longitudinal direction of the midsole, each cushioning projection having a predetermined height profile based on the pressure map.

In any of the various embodiments discussed herein, translating a pressure map into a distal surface profile may include correlating pressure values to height values for the predetermined height profiles of the cushioning projections.

In any of the various embodiments discussed herein, obtaining a pressure map may include measuring the pressures exerted on the bottom of a human foot in contact with the ground. In any of the various embodiments discussed herein, obtaining a pressure map may include measuring the pressures exerted on the bottom of a specific individual's foot in contact with the ground. In any of the various embodiments discussed herein, obtaining a pressure map may include receiving a standard pressure map for a human foot having a particular shoe size. In any of the various embodiments discussed herein, obtaining a pressure map may include receiving a pressure map for a specific individual.

Some embodiments may include an article of footwear including an upper, a midsole coupled to the upper having a forefoot end disposed opposite a heel end in a longitudinal direction, the midsole including a plurality of cushioning projections extending from the midsole at predetermined heights in a direction substantially perpendicular to the longitudinal direction of the midsole, where each cushioning projection has a predetermined height profile based on a pressure map of pressures exerted on the bottom of a human foot when in contact with the ground.

Some embodiments may include a midsole including a plurality of cushioning projections extending from the midsole at predetermined heights in a direction substantially perpendicular to a longitudinal direction of the midsole, where each cushioning projection has a predetermined height profile based on a pressure map of pressures exerted on the bottom of a human foot when in contact with the ground.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A method of making a midsole for an article of footwear, the method comprising:

translating a pressure map of pressures exerted on a bottom of a human foot when in contact with the ground into a distal surface profile defined by distal most surfaces of a plurality of cushioning projections;

selecting a maximum height of each of the plurality of cushioning projections based on data from the pressure map;

selecting a minimum height of each of the plurality of cushioning projections based on the data from the pressure map;

selecting an average height of each of the plurality of cushioning projections based on the data from the pressure map; and forming a midsole comprising a base and the plurality of cushioning projections extending from the base at predetermined heights downwardly in a distal direction perpendicular to a longitudinal direction of the midsole, each cushioning projection having a predetermined height profile defined by the distal most surface of the cushioning projection, the predetermined height profile comprising the selected maximum height, the selected minimum height, and the selected average height for the cushioning projection.

2. The method of claim 1, wherein the data from the pressure map of pressures is used to calculate at least one of the following: (i) peak pressures for different areas of the foot, (ii) mean peak pressures representing the average of the peak pressures for an area of the foot, (iii) pressure-time integrals representing a mean peak pressure and a time over which the peak pressure was applied, (iv) a peak force for an area of the foot, (v) mean peak forces representing an average of peak forces for an area of the foot, or (vi) force-time integrals representing a product of a mean peak force and a time over which the mean peak force was applied.

3. The method of claim 2, wherein the maximum height, the minimum height, and the average height of at least two of the plurality of cushioning projections are based on at least one of (i)-(vi).

4. The method of claim 3, wherein the maximum height, the minimum height, and the average height of the at least two of the plurality of cushioning projections are further based on properties of a material from which the plurality of cushioning projections are made.

5. The method of claim 2, wherein the data from the pressure map of pressures is used to calculate at least two of (i)-(vi), and wherein the maximum height, the minimum height, and the average height of at least two of the plurality of cushioning projections are based on at least two of (i)-(vi).

6. The method of claim 5, wherein the maximum height, the minimum height, and the average height of the at least two of the plurality of cushioning projections are further based on properties of a material from which the plurality of cushioning projections are made.

7. The method of claim 1, wherein the data is collected using an in-shoe pressure measuring system.

8. The method of claim 1, wherein the pressure map of pressures is a composite pressure map of the human foot comprising pressures exerted on the bottom of the foot during a natural gait of the foot.

9. The method of claim 1, wherein the pressure map of pressures is obtained using an on-site pressure mapping device at a point-of-sale location.

10. The method of claim 1, wherein the pressure map is a standard pressure map for a human foot having a particular shoe size.

11. The method of claim 1, wherein the pressure map is a pressure map for a specific individual.

12. The method of claim 1, wherein the minimum height of at least one of the plurality of cushioning projections is located between opposing edges of the at least one cushioning projection.

13. The method of claim 1, wherein the minimum height of at least one of the plurality of cushioning projections is located at one peripheral edge of the at least one cushioning projection and the maximum height of the at least one cushioning projection is located at another peripheral edge of the at least one cushioning projection.

14. The method of claim 1, wherein the predetermined height profiles of two of the cushioning projections have a different contour than one another.

15. The method of claim 1, wherein the height profile of at least one of the plurality of cushioning projections varies in the longitudinal direction and a transverse direction perpendicular to the longitudinal direction based on the data from the pressure map of pressures.

16. The method of claim 1, wherein a first cushioning projection of the plurality of cushioning projections is made of a first material and a second cushioning projection of the plurality of cushioning projections is made of a second material different from the first material.

17. The method of claim 1, wherein a first cushioning projection of the plurality of cushioning projections is made of a material and a second cushioning projection of the plurality of cushioning projections is made of the same material, and wherein the material of the first cushioning projection comprises different material properties than the material of the second cushioning projection.

18. The method of claim 1, wherein the plurality of cushioning projections comprises:

a first plurality of cushioning projections disposed within an open cavity in a forefoot portion of the midsole, a second plurality of cushioning projections disposed within the open cavity in a midfoot portion of the midsole, and a third plurality of cushioning projections disposed within the open cavity in a heel portion of the midsole, and wherein the first, second, and third plurality of cushioning projections comprise cushioning projections disposed side-by-side within the open cavity in one or more continuous rows such that the side-by-side cushioning projections are directly adjacent to each other.

19. The method of claim 1, wherein the distal surface profile comprises an undulating overall surface profile comprising one or more valleys and one or more peaks defined by the plurality of cushioning projections.

20. A method of making a midsole for an article of footwear, the method comprising:

obtaining a pressure map of pressures exerted on a bottom of a human foot when in contact with the ground;

translating the pressure map of pressures into a distal surface profile defined by distal most surfaces of a plurality of cushioning projections;

selecting a maximum height of each of the plurality of cushioning projections based on data from the pressure map;

selecting a minimum height of each of the plurality of cushioning projections based on the data from the pressure map;

selecting an average height of each of the plurality of cushioning projections based on the data from the pressure map;

forming a core midsole comprising the plurality of cushioning projections extending at predetermined heights in a distal direction perpendicular to a longitudinal direction of the midsole, each cushioning projection having a predetermined height profile defined by the distal most surface of the cushioning projection, the predetermined height profile comprising the selected maximum height, the selected minimum height, and the selected average height for the cushioning projection; and forming a peripheral midsole around the core midsole such that the plurality of cushioning projections are disposed side-by-side within an open cavity defined by a sidewall of the peripheral midsole, wherein side-by-side cushioning projections are disposed directly adjacent to each other in one or more continuous rows.

21. The method of claim 20, wherein the method further comprises integrally forming the core midsole and the peripheral midsole together.

* * * * *